US011553740B2

(12) United States Patent
MacColl et al.

(10) Patent No.: US 11,553,740 B2
(45) Date of Patent: Jan. 17, 2023

(54) GARMENTS HAVING BODICE SYSTEMS FOR BREAST LIFT, SHAPE, SUPPORT, AND COMFORT

(71) Applicant: Up All Nightie, LLC, Wayne, PA (US)

(72) Inventors: Sarah Brooke MacColl, Haverford, PA (US); Rebecca Susan Novak, St. Louis, MO (US); Nicola Victoria Hopkins, London (GB)

(73) Assignee: Up All Nightie, LLC, Wayne, PA (US)

( * ) Notice: Subject to any disclaimer, the term of this patent is extended or adjusted under 35 U.S.C. 154(b) by 0 days.

(21) Appl. No.: 17/671,038

(22) Filed: Feb. 14, 2022

(65) Prior Publication Data

US 2022/0256942 A1 Aug. 18, 2022

Related U.S. Application Data

(60) Provisional application No. 63/149,377, filed on Feb. 15, 2021.

(51) Int. Cl.

| | |
|---|---|
| ***A41C 3/08*** | (2006.01) |
| ***A41C 3/14*** | (2006.01) |
| ***A41C 3/12*** | (2006.01) |

(52) U.S. Cl.

CPC ..... *A41C 3/08* (2013.01); *A41C 3/122* (2013.01); *A41C 3/14* (2013.01)

(58) Field of Classification Search

None

See application file for complete search history.

(56) References Cited

U.S. PATENT DOCUMENTS 1,904,644 A * 4/1933 Le May ..... A41C 3/0021 450/59
1,923,821 A * 8/1933 Gudeman ..... A41C 3/00 450/85

(Continued)

FOREIGN PATENT DOCUMENTS

AU 2013100481 A4 5/2013
DE 2046370 A1 3/1972

(Continued)

OTHER PUBLICATIONS

European Patent Office, International Search Report for related PCT Application No. PCT/US2022/016426, dated May 13, 2022.

(Continued)

*Primary Examiner* — Jocelyn Bravo
(74) *Attorney, Agent, or Firm* — Koiitch Romano Dascenzo Gates LLC

(57) ABSTRACT

A bodice system includes a combination of stretch and non-stretch fabrics and/or textiles that are shaped, arranged, layered, and connected from front to back, to provide lift, shape, and support to a wearer's breasts in a comfortable garment. The bodice system includes an under-bust cradle, an elastic support band around the wearer's torso, three-piece left and right breast cups, a curved sling within each of the breast cups, left and right shoulder straps, and a flexible back aligning member integrally formed with each of the shoulder straps. The elastic support band is coupled to the under-bust cradle along the anterior portion of the bodice system, and to the back aligning member along the posterior portion of the bodice system. The interconnectedness of the components of the bodice system enable front-to-back lift, shape, and support for the wearer's breasts, even breasts that are D-cup and larger in size or volume.

22 Claims, 7 Drawing Sheets

(56) References Cited

U.S. PATENT DOCUMENTS 1,970,920 A * 8/1934 Roth ..... A41C 3/00 450/48
2,100,890 A * 11/1937 Witkower ..... A41C 3/00 450/59
2,362,974 A * 11/1944 Cohen ..... A41C 3/0021 450/59
2,431,829 A * 12/1947 Redares ..... A41C 3/00 450/59
2,475,624 A * 7/1949 Laszlo ..... A41C 3/0057 D2/709
2,497,324 A * 2/1950 Schenkman ..... A41C 3/0021 2/338
2,553,225 A * 5/1951 Weaver ..... A41C 3/0021 450/59
2,607,038 A * 8/1952 Spare ..... A41C 3/0021 450/59
2,613,365 A * 10/1952 Fairbanks ..... A41C 3/124 2/57
2,663,872 A * 12/1953 Diebold ..... A41C 3/0021 450/60
2,703,885 A * 3/1955 Davis ..... A41C 3/00 450/82
3,078,851 A * 2/1963 Sachs ..... A41C 3/00 450/86
3,208,453 A * 9/1965 Cole ..... A41C 3/00 450/4
3,213,462 A * 10/1965 Ramsell ..... A41C 3/0021 450/64
3,263,685 A * 8/1966 Bernfeld ..... A41C 3/00 450/86
3,306,299 A * 2/1967 Paramore ..... A41C 3/0007 450/86
3,316,915 A * 5/1967 Howell ..... A41D 10/00 2/73
3,339,553 A 9/1967 Ritter
3,396,728 A * 8/1968 Astor ..... A41C 3/00 450/74
3,465,754 A * 9/1969 Lockwood ..... A41C 3/00 450/86
3,506,014 A * 4/1970 Sorenson ..... A41C 3/0021 450/86
3,548,832 A * 12/1970 Rosner ..... A41C 3/00 450/59
3,559,653 A * 2/1971 Jannicelli, Jr. ..... A41C 3/00 450/74
3,566,878 A * 3/1971 Radomski ..... A41C 3/00 450/74
3,606,891 A * 9/1971 Marcario et al. ..... A41C 3/00 450/80
3,699,971 A * 10/1972 Hittel ..... A41C 3/0028 450/67
3,709,230 A * 1/1973 Rich ..... A41C 3/0021 450/62
3,750,673 A * 8/1973 Penrock ..... A41C 3/0007 450/41
3,771,528 A * 11/1973 May ..... A41C 3/00 450/74
3,779,250 A * 12/1973 Radomski ..... A41C 3/00 450/74
3,866,617 A * 2/1975 Gluckin ..... A41C 3/00 450/60
3,952,752 A * 4/1976 Huttle, Jr. ..... A41C 3/0021 450/60
4,024,876 A * 5/1977 Penrock ..... A41C 3/148 623/7
4,144,912 A * 3/1979 Pundyk ..... A41C 3/00 450/60
4,154,249 A * 5/1979 Darring ..... A41C 1/06 450/14
4,174,717 A * 11/1979 Schreiber ..... A41C 3/0057 450/86
4,311,150 A * 1/1982 Schreiber ..... A41C 3/0057 450/86
D265,265 S * 7/1982 Stern ..... D2/710
4,633,876 A * 1/1987 Scullin ..... A41C 3/04 450/36
4,698,847 A * 10/1987 Yoshihara ..... A41C 1/06 450/7
5,149,293 A * 9/1992 Gable ..... A44B 11/04 2/101
5,461,725 A * 10/1995 Witczak ..... A41D 1/215 450/32
5,643,043 A * 7/1997 Pflum ..... A41C 3/0057 450/86
5,660,577 A * 8/1997 Modena ..... A41C 3/00 450/86
5,873,768 A * 2/1999 Fleischman-Ament ..... A41C 3/0071 450/67
5,908,346 A * 6/1999 McCall ..... A41C 3/0007 2/73
6,174,217 B1 * 1/2001 Judson ..... A41C 3/0042 450/7
6,276,175 B1 8/2001 Browder, Jr.
6,280,287 B1 * 8/2001 Keith ..... A41F 1/006 450/41
6,386,944 B2 * 5/2002 Keith ..... A41C 3/0028 450/41
6,425,799 B1 * 7/2002 Pai ..... A41C 3/0007 450/41
6,846,217 B1 * 1/2005 Struble ..... A41C 3/08 450/7
6,983,489 B2 1/2006 Caprio
7,488,234 B2 2/2009 Rothman et al.
7,546,751 B2 6/2009 Lutz
8,128,457 B2 * 3/2012 Reinisch ..... A41C 3/0057 450/59
8,257,138 B2 * 9/2012 Smith ..... A41C 3/00 450/74
8,337,275 B2 * 12/2012 Martins-Crawbuck ..... A41C 3/0028 450/64
8,506,350 B1 8/2013 Silverman et al.
8,523,629 B2 * 9/2013 Pundyk ..... A41C 3/0057 450/36
9,022,833 B2 * 5/2015 Deming ..... A41D 13/1245 450/30
9,259,038 B2 2/2016 Cholet et al.
9,320,305 B1 * 4/2016 Berger ..... A41C 3/08
D804,778 S * 12/2017 Jameson ..... D2/706
9,949,515 B2 4/2018 Wilkins et al.
10,485,270 B2 * 11/2019 Wesley ..... A41C 3/12
10,575,567 B1 * 3/2020 Krechmaras ..... A41C 3/12
10,595,568 B2 * 3/2020 Parkinson ..... A41C 3/12
10,736,364 B2 * 8/2020 Liu ..... A61F 5/026
11,051,964 B1 * 7/2021 Lee ..... A41C 3/005
11,229,242 B2 * 1/2022 Breitwieser ..... A41C 3/0028
D950,193 S * 5/2022 Menczer ..... D2/706
2007/0054597 A1 * 3/2007 Mone ..... A41C 3/00 450/54
2008/0244805 A1 10/2008 Griffin
2009/0098803 A1 * 4/2009 Reinisch ..... A41C 3/0014 450/86
2009/0305608 A1 * 12/2009 Bonnin ..... B29C 66/301 450/39
2012/0129425 A1 * 5/2012 Bevans ..... A41D 1/06 450/11
2012/0244782 A1 * 9/2012 Pundyk ..... A41C 3/0057 450/70
2012/0302137 A1 * 11/2012 Moylan ..... A41C 3/0057 450/86
2013/0122780 A1 * 5/2013 McCall ..... A41C 3/0014 450/36
2015/0056889 A1 2/2015 Crompton
2015/0208737 A1 7/2015 Nevins
2015/0223524 A1 * 8/2015 Brady ..... A41D 1/089 450/156

(56) References Cited

U.S. PATENT DOCUMENTS

| | | | | |
|---|---|---|---|---|
| 2015/0320122 | A1* | 11/2015 | Hirakubo | A41C 3/0021 450/55 |
| 2015/0342267 | A1* | 12/2015 | Lau | A41C 3/0014 450/92 |
| 2016/0029706 | A1* | 2/2016 | Braverman | A41C 3/06 450/55 |
| 2016/0374405 | A1* | 12/2016 | Washington | A41C 1/02 450/76 |
| 2018/0035724 | A1* | 2/2018 | Blibech | A41C 3/0057 |
| 2018/0055097 | A1* | 3/2018 | Delaney | A41C 3/08 |
| 2019/0208834 | A1* | 7/2019 | Thompson | A41C 3/0007 |
| 2020/0323278 | A1* | 10/2020 | Roddis | A41C 3/005 |
| 2021/0251308 | A1* | 8/2021 | Kaylin | A41C 3/142 |
| 2021/0401070 | A1* | 12/2021 | Sorokina | A41C 3/0057 |

FOREIGN PATENT DOCUMENTS

| | | | |
|---|---|---|---|
| EP | 3087854 | B1 | 6/2018 |
| GB | 2434077 | | 7/2007 |
| KR | 200483514 | Y1 | 5/2017 |

OTHER PUBLICATIONS

Machine generated English language translation of German Patent Application Publication No. DE2046370A1, published Mar. 23, 1972.

Machine generated English language translation of European Office Patent No. EP3087854B1, published Apr. 13, 2016.

Machine generated English language translation of Republic of Korea Patent No. KR200483514Y1, published May 24, 2017.

MINDD Bra—MINDD Tech Bra Company product information downloaded from www.minddbra.com/pages/mindd-tech on Jan. 18, 2022.

MagicLift by Galmorise—product details downloaded from images-na.ssl-images-amazon.com/images/I/81NsJGv-FfL._UL1500_.jpg on Jan. 5, 2022.

Hanes Cross Over Bra—product information page downloaded from www.cilory.com/bras/37245-hanes-cross-over-bra.html on Jan. 5, 2022.

Nanfoo—Sports Bra product image downloaded from www.dhresource.com/0x0s/f2-albu-g6-M01-10-04-rBVaSFsPtxuAYt1dAAI8LWygINs499.jpg/hot-front-cross-sport-bras-women-yoga-bras.jpg on Jan. 5, 2022.

Image of bra with torso band, cross in front straps, and under-bust framework downloaded from hips.hearstapps.com/hmg-prod.s3.amazonaws.com/images/again-1552328037.png?crop=1.00xw:0.799xh;0,0.0964xh&resize=480:* on Jan. 5, 2022.

* cited by examiner

GARMENTS HAVING BODICE SYSTEMS FOR BREAST LIFT, SHAPE, SUPPORT, AND COMFORT

RELATED APPLICATION

This application claims priority to U.S. Provisional Patent Application No. 63/149,377, entitled "GARMENT FOR BREAST LIFT, SHAPE, SUPPORT, AND COMFORT," which was filed on Feb. 15, 2021, the complete disclosure of which is incorporated herein by reference.

FIELD

The present invention relates generally to apparel, and in particular, to garments including a bodice system configured to provide lift, shape, support, and comfort to a wearer's breasts.

BACKGROUND

At nighttime, unsupported, sagging, and/or drooping breasts (known as breast ptosis) can disrupt sleep and may cause feelings of discomfort, unattractiveness, or self-consciousness. Breast ptosis is common, with age, breast size, weight, pregnancy, and breastfeeding all being potential contributing factors. While lifted and supported breasts may contribute to a better night's sleep, bras and other conventional breast-supportive garments typically worn during the day often include underwires and/or clasps, closures, or other hardware, and are thus uncomfortable to wear overnight, at least partially due to this hardware. On the other hand, conventional nightwear garments do not provide the lift, shape, and support to counteract breast ptosis, especially for larger size breasts.

Namely, conventional nightwear garments fails to provide breast lift, shape, support, and comfort in one garment.

Those with larger breast volume/weight looking for attractive and comfortable nightwear that beautifully lifts and shapes breasts are underserved, creating a need gap in today's intimate apparel market. Often, conventional breast-supportive garments use said uncomfortable wiring and/or hardware to attempt to provide breast lift, support, and separation, but these garments have a tendency to deliver unnatural and unattractive breast lift, shape, and cleavage that isn't comfortable or desirable to the wearer. Alternatively, many conventional breast-supportive garments that deliver comfort forgo breast lift, shape, and support altogether, leaving breasts sagging, drooping, or falling out of place. Even conventional breast-supportive garments that claim to lift, shape, and support larger size breasts do not have the technical elements and level of integrated construction to successfully lift, shape, and support larger breasts, such as D-cup and larger size breasts.

Conventional breast-supportive garments have other disadvantages, as well. For example, they may have sewn-in bands that do not stay in the correct placement on the wearer's body, and thus allow breasts to fall under or below the band and ride-up along the back. They can have triangle shaped cutouts for the breasts which don't support the woman's natural shape, and lack support, thereby allowing breasts to fall out along the sides. Most also have narrow, adjustable straps not strong enough to lift heavier breasts. Conventional breast-supportive garments also can be too severe or overbearing in forcing the breasts into unnatural or uncomfortable shapes. Conventional breast-supportive garments with multiple adjustment points, closures, and adjustable straps often are cumbersome to use at nighttime and are not comfortable to wear all night. Foam structures in breast cups of conventional breast-supportive garments generally results in unnatural breast shape, as do breast cups formed with straight-edged pieces.

SUMMARY

Presently disclosed garments include a bodice system having a combination of stretch and non-stretch fabrics and textiles that are shaped, arranged, layered, and connected from front to back, to provide lift, shape, and support to a wearer's breasts in a comfortable garment. The added benefit of round, full breasts with natural-looking cleavage may allow wearers to feel confident and attractive while wearing a nighttime garment that is intended to look flattering. The bodice system includes an under-bust cradle, an elastic support band extending circumferentially around the wearer's torso, three-piece left and right breast cups, a curved sling within each of the breast cups, left and right shoulder straps, and a flexible back aligning member integrally formed with the shoulder straps. The components of the bodice system work together to provide comfortable front-to-back lift, shape, and support for breasts, even breasts larger than D-cup in size, in a garment that may be configured for overnight wear. In some examples, the under-bust cradle provides a stabilizing foundation around the entire interior portion of the garment against the wearer's body, and the elastic support band holds the under-bust cradle in place and provides maximum support and lift, even for larger size breasts. Such breast-supportive garments, associated articles of clothing, and methods of donning breast-supportive garments and articles of clothing are disclosed herein.

In an illustrative example, a garment has a bodice system configured to provide lift, shape, support, and comfort to a wearer's breasts. The bodice system may include an under-bust cradle configured to be positioned inferior to the wearer's breasts when the garment is worn. A superior edge of the under-bust cradle may extend along a left breast root seam of a left breast cup and a right breast root seam of a right breast cup of the bodice system, with the left breast root seam and the right breast root seam being configured to be positioned along a breast root of the wearer when the garment is worn. The bodice system may further include an elastic support band configured to extend circumferentially around the wearer's torso when the garment is worn. An anterior portion of the elastic support band may be coupled to and positioned inferior to the under-bust cradle, and the elastic support band and the under-bust cradle together may be configured to support the wearer's breasts.

The bodice system further may include the left breast cup and the right breast cup, with each of the left and right breast cups including a lateral piece, a medial piece, and a superior piece. The lateral piece may be coupled to the medial piece such that the medial piece is positioned medially to the lateral piece when the garment is worn, and the superior piece may be coupled to the lateral piece and the medial piece such that the superior piece is positioned superiorly to the lateral piece and the medial piece when the garment is worn. The bodice system further may include a left curved sling and a right curved sling. Each of the left curved sling and the right curved sling may be configured to work with the left breast cup and the right breast cup, respectively, to lift, shape, and support the wearer's breasts by urging the wearer's breasts in medial and superior directions. The left curved sling may be sized and positioned to overlap with at least a portion of the lateral piece, the medial piece, and the superior piece of the left breast cup, and the right curved sling may be sized and positioned to overlap with at least a portion of the lateral piece, the medial piece, and the superior piece of the right breast cup.

The bodice system further may include a left shoulder strap coupled to the left breast cup and a right shoulder strap coupled to the right breast cup, along with a flexible back aligning member extending inferiorly from the left shoulder strap and the right shoulder strap. At least a portion of the flexible back aligning member may be coupled to the elastic support band along a posterior portion of the elastic support band. The flexible back aligning member may be configured to be positioned against, or adjacent, the wearer's back when the garment is worn.

In another illustrative example of disclosed garments having a bodice system configured to provide lift, shape, support, and comfort to a wearer's breasts, the bodice system may include a left breast cup and a right breast cup. Each of the left and right breast cup may include an inner layer positioned nearest the wearer's skin when the garment is worn, an outer layer positioned facing outwardly from the wearer when the garment is worn, and a middle layer sandwiched between the inner and outer layers. The inner layer of each breast cup may be formed of at least three pieces including a first lateral piece, a first medial piece, and a first superior piece, with the first lateral piece being coupled to the first medial piece such that the first medial piece may be positioned medially to the first lateral piece when the garment is worn. The first superior piece also may be coupled to the first lateral piece and the first medial piece such that the first superior piece is positioned superiorly to the first lateral piece and the first medial piece when the garment is worn. Similarly, the outer layer of each breast cup may be formed of at least three pieces including a second lateral piece, a second medial piece, and a second superior piece. The second lateral piece may be coupled to the second medial piece such that the second medial piece is positioned medially to the second lateral piece when the garment is worn, and the second superior piece may be coupled to the second lateral piece and the second medial piece such that the second superior piece is positioned superiorly to the second lateral piece and the second medial piece when the garment is worn. The middle layer of each breast cup also may be formed of at least three pieces, which may include a third lateral piece, a third medial piece, and a third superior piece. The third lateral piece may be coupled to the third medial piece such that the third medial piece is positioned medially to the third lateral piece when the garment is worn, and the third superior piece may be coupled to the third lateral piece and the third medial piece such that the third superior piece is positioned superiorly to the third lateral piece and the third medial piece when the garment is worn.

The bodice system also may include a left curved sling and a right curved sling, with each of the left curved sling and the right curved sling being configured to support the wearer's breasts by urging the wearer's breasts in medial and superior directions. The left curved sling may be positioned between the inner layer and the middle layer of the left breast cup, and wherein the right curved sling may be positioned between the inner layer and the middle layer of the right breast cup. An under-bust cradle may be positioned inferior to the wearer's breasts when the garment is worn, and may include an inner cradle layer and an outer cradle layer. The inner cradle layer may be coupled to the first medial piece, the first lateral piece, and the first superior piece of each of the left breast cup and the right breast cup, and the outer cradle layer may be coupled to the second medial piece, the second lateral piece, and the second superior piece of each of the left breast cup and the right breast cup. An elastic support band may extend circumferentially around the wearer's torso when the garment is worn, with the elastic support band being positioned inferior to the under-bust cradle. The elastic support band may be coupled to the inner cradle layer, such that the elastic support band and the under-bust cradle together are configured to support the wearer's breasts. The garment also may include a skirt extending inferiorly from the under-bust cradle.

DESCRIPTION

Figure 1:
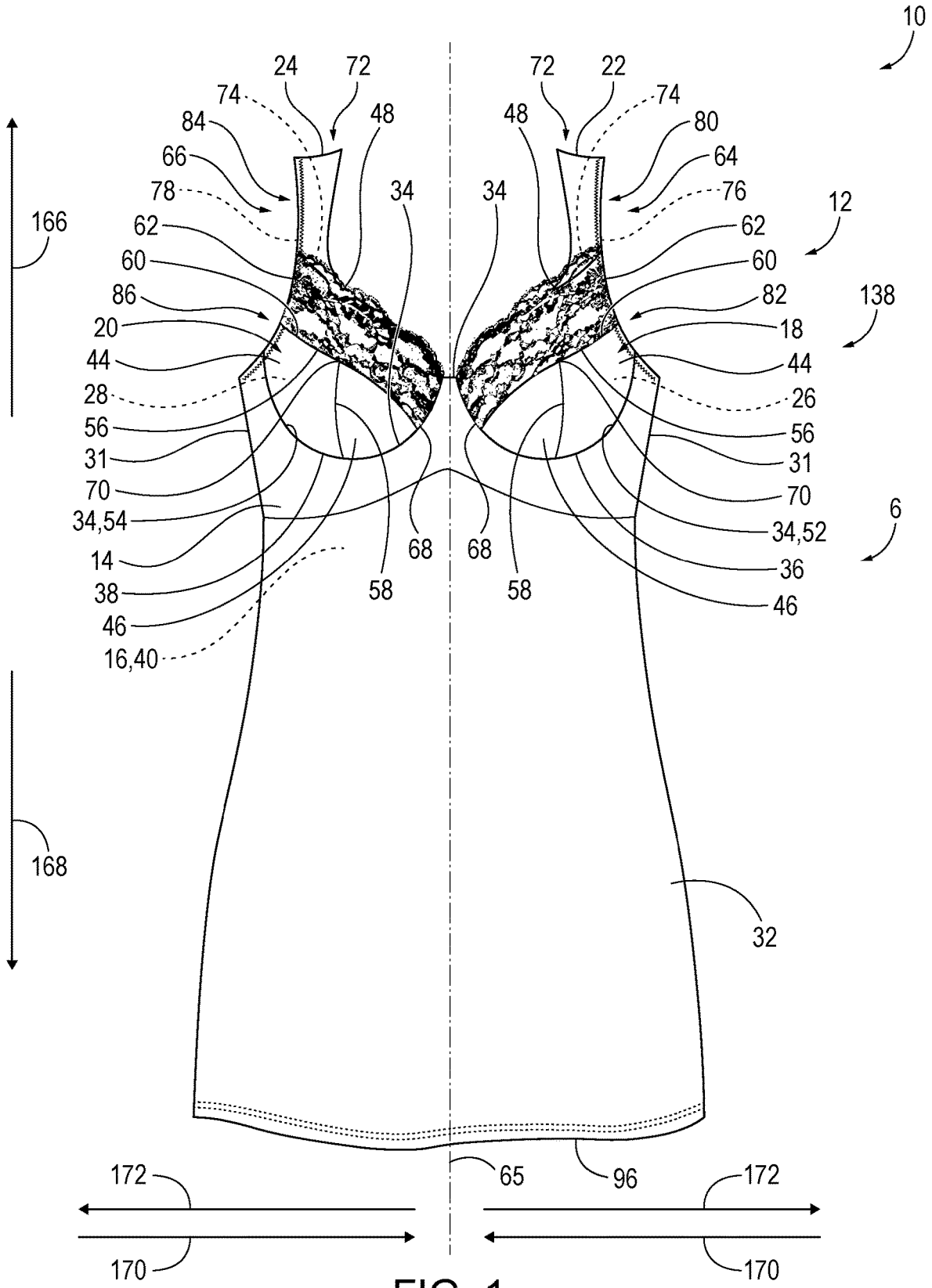
FIG. 1 is a front elevation view of an example of a garment having an incorporated bodice system according to the present disclosure.
Figure 2:
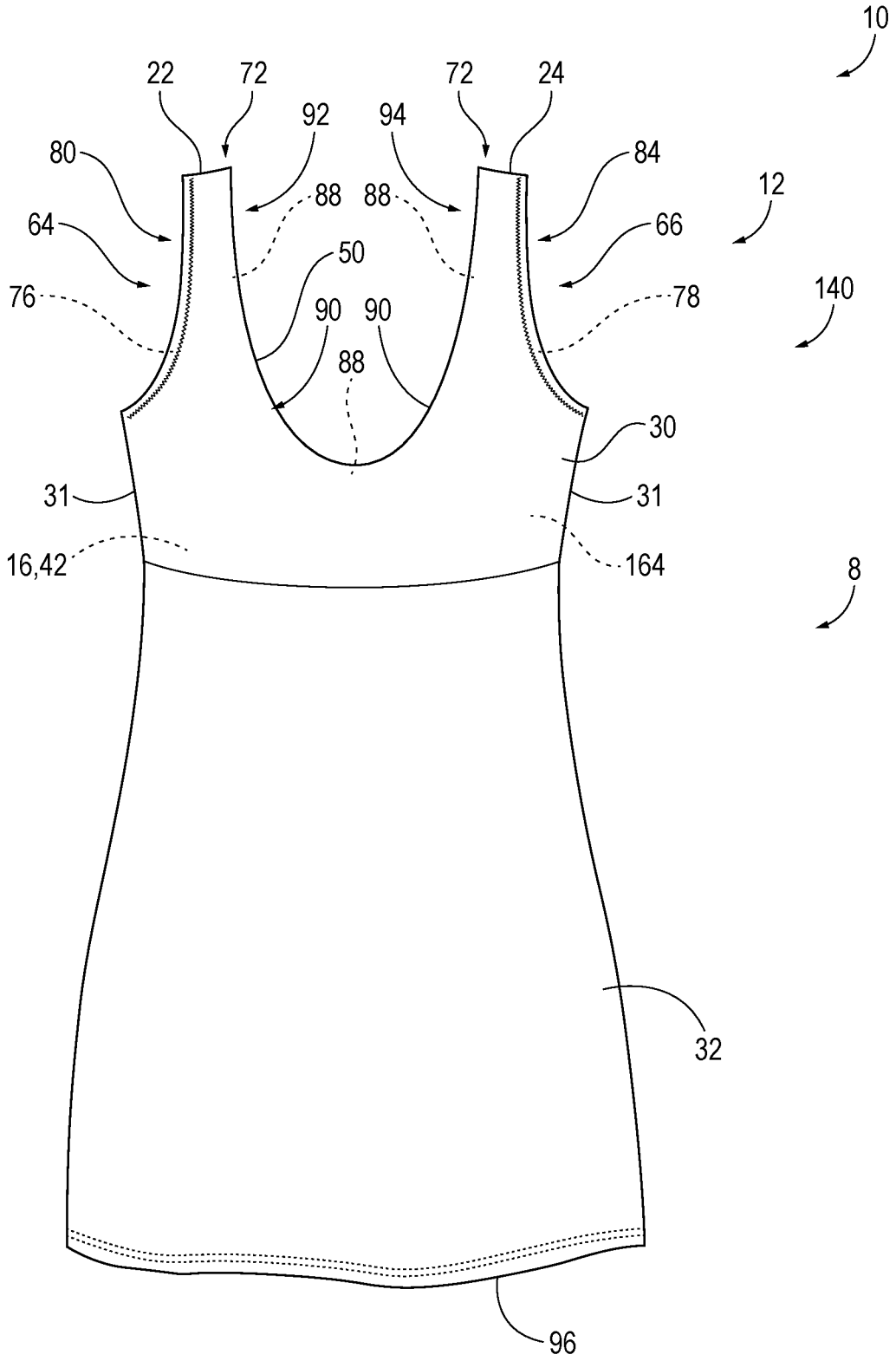
FIG. 2 is a back elevation view of the garment and bodice system of FIG. 1.

FIGS. 1-2 provide illustrative, non-exclusive examples of garments 10 and bodice systems 12 according to the present disclosure. Elements that serve a similar, or at least substantially similar, purpose are labeled with like numbers in each of FIGS. 1-2, and these elements may not be discussed in detail herein with reference to each of FIGS. 1-2. Similarly, all elements may not be labeled in each of FIGS. 1-2, but reference numerals associated therewith may be utilized herein for consistency. Elements, components, and/or features that are discussed herein with reference to one or more of FIGS. 1-2 may be included in and/or utilized with the examples of any of FIGS. 1-9 (and vice versa) without departing from the scope of the present disclosure. In general, elements that are likely to be included in a given (i.e., a particular) example are illustrated in solid lines, while elements that are optional to a given example are illustrated in dashed lines. However, elements that are shown in solid lines are not essential to all examples, and an element shown in solid lines may be omitted from a particular example without departing from the scope of the present disclosure.

FIG. 1 illustrates garment 10 with integrally formed bodice system 12 shown from a front, or anterior side 6 of garment 10, while FIG. 2 illustrates garment 10 from a back, or posterior side 8 of garment 10. Generally speaking, disclosed bodice systems 12 include a combination of stretch and non-stretch fabrics and textiles (e.g., elastic and non-elastic fabrics and textiles) that are shaped, arranged, layered, and connected from front to back, to provide lift, shape, and support to a wearer's breasts in a comfortable garment, which is configured to lift, shape, and support even larger size breasts (e.g., D-cup and larger, which require lifting of a heavier weight load than smaller size breasts). The added benefit of lifted, round, full breasts may allow wearers to feel confident and attractive while wearing a garment that is intended to look flattering. While conventional breast-supportive garments have been unsuccessful in providing lift, shape, support, and comfort to larger size breasts, disclosed garments 10 and integrated bodice systems 12 are configured to provide the same via the interconnected components that provide front-to-back support for the wearer, as described herein. Thus, disclosed garments 10 and bodice systems 12 may be configured to alleviate or mitigate breast ptosis by providing a stable supporting shelf, lift, and shaping to the wearer's breasts, including larger size breasts (e.g., D-cup and larger), in a comfortable and aesthetically pleasing arrangement, and without flattening or smashing down the overbust area.

With reference to FIGS. 1 and 2, bodice system 12 includes an under-bust cradle 14, an elastic support band 16, a left breast cup 18, a right breast cup 20, a left shoulder strap 22, a right shoulder strap 24, a left curved sling 26, a right curved sling 28, and a flexible back aligning member 30 (which also may be referred to herein simply as back aligning member 30). The example of garment 10 of FIGS. 1-2 also includes a skirt 32 extending inferiorly from under-bust cradle 14, though other examples of bodice system 12 and/or garment 10 may be provided in other shapes, forms, or types of garments, with or without such skirt 32. Components of bodice system 12 may not all be visible from the exterior of garment 10. For example, in the garment 10 of FIGS. 1-2, elastic support band 16, left curved sling 26, and right curved sling 28 are obscured from view due to the placement of other layers and components of bodice system 12. Generally, under-bust cradle 14 and elastic support band 16 together may form a stabilizing base, or shelf for bodice system 12 to create the foundation to enable the rest of bodice system 12 to support the wearer's breasts, while the other components of bodice system 12 (e.g., left and right breast cups 18, 20, left and right curved slings 26, 28, left and right shoulder straps 22, 24, and flexible back aligning member 30) may work together to provide lift to the wearer's breasts, which is at least partially enabled by the interconnectedness of these components to under-bust cradle 14 and elastic support band 16. Under-bust cradle 14 and elastic support band 16 are thus said to "support the wearer's breasts," or "help support the wearer's breasts," as used herein, when incorporated into disclosed bodice systems 12. Components of bodice system 12 may be interfaced or coupled together as described herein, in a manner configured to create continuous lift from under-bust cradle 14, along left and right curved slings 26, 28 and all the way through left and right shoulder straps 22, 24.

Disclosed garments 10 and bodice systems 12 may be configured to encourage the wearer's breasts to remain in place within left and right breast cups 18, 20, thereby tending to reduce or prevent the wearer's breasts from falling out of their position in garment 10, popping out, spilling to lateral sides, falling below elastic support band 16, or excessively shifting around, due to the shape and placement of elements and components, including non-stretch curved slings 26, 28. Bodice systems 12 may be used in, or incorporated into, nightwear or in other situations or contexts where a bra is undesirable to alleviate breast ptosis. Presently disclosed garments 10 and/or bodice systems 12 may be provided in an extensive size range for wearers looking for breast lift and shape, though have been designed and tested with larger size breasts (e.g., D-cup and larger) in mind to improve design efficacy and construction integrity for wearers with larger size breasts.

Some or all of under-bust cradle 14 is configured to be positioned inferior to the wearer's breasts when garment 10 is worn. For example, as seen in FIG. 1, a portion of under-bust cradle 14 is inferior to left breast cup 18 and right breast cup 20, a portion of under-bust cradle 14 is medial to left breast cup 18 and right breast cup 20, and portions of under-bust cradle 14 may extend laterally from left breast cup 18 and right breast cup 20 as well. Under-bust cradle 14 generally extends across the entire anterior side 6 of garment 10, though in some examples may extend across just a portion of anterior side 6 of garment 10. A superior edge 34 of under-bust cradle 14 extends along a left breast root seam 36 of left breast cup 18, and along a right breast root seam 38 of right breast cup 20. Said left breast root seam 36 and right breast root seam 38 generally are configured to be positioned along a breast root of the wearer (e.g., the base of the wearer's breasts, sometimes referred to as the inframammary crease) when garment 10 is worn. In some examples, superior edge 34 of under-bust cradle 14 includes a first superior edge portion 52 that is at least substantially congruent with left breast root seam 36, and a second superior edge portion 54 that is at least substantially congruent with right breast root seam 38. In some examples, it may be said that under-bust cradle 14 (e.g., superior edge 34 of under-bust cradle 14) encircles, or outlines, the entire cup seam along breast root seams 36, 38 (e.g., under-bust cradle 14 may be present beneath and/or around lateral, medial, and superior pieces 44, 46, and 48 of left and right breast cups 18, 20), which functionally and/or visually may be configured to mimic a conventional underwire arrangement, but without the discomfort or digging often experienced with such conventional underwire arrangements. This may correspond with a binding extending along left and right breast room seams 36, 38, as discussed in further detail herein. Under-bust cradle 14 may have a generally W-shaped footprint, as illustrated, such that under-bust cradle 14 may be present along the silhouette of the wearer's breast roots, as noted, as well as medially between the wearer's breasts and outside the lateral sides of the wearer's breasts.

Under-bust cradle 14 may be configured to provide a stabilizing foundation for bodice system 12 against the wearer's body (e.g., against the front of the wearer's torso). Under-bust cradle 14 is typically continuous with or coupled to back aligning member 30 along a side seam 31 on one or both sides of bodice system 12, which may be configured to be positioned on lateral sides of the wearer's body when garment 10 is worn. Under-bust cradle 14 further may be configured to provide structure and stability for left breast cup 18 and right breast cup 20, effectively serving as a base, or "shelf" for left and right breast cups 18, 20 and left and right curved slings 26, 28. For example, under-bust cradle 14 may be configured to secure a position of each of left breast cup 18 and right breast cup 20 with respect to the wearer's breasts and/or torso when garment 10 is worn. In some examples, the shelf created by under-bust cradle 14 (and by virtue of its connection to other components of bodice system 12) may be configured to prevent the wearer's breasts from falling inferior to under-bust cradle 14, by providing a stabilizing base for bodice system 12 from which lift is created via other components of bodice system 12. The stabilizing function of under-bust cradle 14 is accomplished in some examples by constructing under-bust cradle 14 at least partially from low-stretch and/or non-stretch textiles (e.g., non-elastic textiles, or textiles with little-to-no elasticity) so that under-bust cradle 14 is configured to stay in place on the wearer's body, and further contributes to correct placement of left breast cup 18 and right breast cup 20 via the coupling between the breast cups 18, 20 and under-bust cradle 14. The extent to which under-bust cradle 14 extends across the anterior side of the wearer's torso also contributes to the structure and stability enabled by, or provided by, under-bust cradle 14, and under-bust cradle 14 typically extends across at least substantially the entire anterior side 6 of garment 10, at least substantially an entire anterior side 138 of bodice system 12, and/or at least substantially the entire anterior side of the wearer's torso (when garment 10 is properly fitted, and worn by the wearer).

Additionally or alternatively, left breast root seam 36 and right breast root seam 38 of bodice system 12 may be formed of, or include a flexible binding, a bound seam, and/or piping along the seams that is configured to increase stability and support of left breast cup 18 and right breast cup 20, and/or definition of the breast shape of left and right breast cups 18, 20, without the use of underwire or hardware. In some examples, said binding may be formed of Modal, or other soft stretch fabric, though any suitable material may be used that helps left and right breast cups 18, 20 create support for the wearer's breasts, while limiting or preventing potential discomfort to the wearer while garment 10 is worn. In some examples, left breast root seam 38 and right breast root seam 38 have an increased thickness as compared to the rest of left and right breast cups 18, 20, which may provide additional support under and around the wearer's breasts (e.g., along the breast roots of the wearer's breasts). In some examples, the binding along left and right breast root seams 36, 38 may be formed along an inner layer of, and/or on the inside of bodice system 12, and may serve to join or combine two or more layers of left and right breast cups 18, 20 together along left and right breast root seams 36, 38, respectively. One or more layers of under-bust cradle 14 also may be sewn into the binding created along left and right breast root seams 36, 38.

Elastic support band 16 of bodice system 12 is configured to extend circumferentially around the wearer's torso when garment 10 is worn, and generally extends around an entire circumference of bodice system 12. An anterior portion 40 of elastic support band 16 is coupled to and positioned inferior to at least a portion of under-bust cradle 14. Elastic support band 16 and under-bust cradle 14 together are configured to provide a stabilizing foundation for bodice system 12 to support the wearer's breasts from beneath the breasts. A posterior portion 42 of elastic support band 16 is positioned on posterior side 8 of garment 10, shown in FIG. 2. Generally, elastic support band 16 is a substantially continuous band such that anterior portion 40 and posterior portion 42 are integrally formed or coupled together to hug the wearer's torso or ribcage around the entire body circumference when garment 10 is worn. In other words, elastic support band 16 generally extends across the entire anterior side 6 and posterior side 8 of garment 10. That said, in examples of garment 10, elastic support band 16 may not be exposed or visible from the outside when garment 10 is worn. This technical effect may be accomplished via securing elastic support band 16 to interior layers of bodice system 12 that are not positioned on the outer surface of garment 10, as will be described herein.

Elastic support band 16 may be formed of plush back elastic to provide comfort for the wearer against the wearer's skin. The elasticity of elastic support band 16 may be selected such that elastic support band 16 is configured to provide firm but non-restrictive hold around and against the wearer's torso. In some examples, the elasticity of elastic support band 16 is selected such that elastic support band 16 is configured to serve as a basis of support so that the wearer's breasts do not fall below elastic support band 16. In other words, elastic support band 16 may be configured to be tight enough to prevent it from riding up along the wearer's torso (e.g., elastic support band 16 may be configured to remain inferior to the wearer's breasts when garment 10 is worn), but without being so inflexible or tight that it digs in or is uncomfortable. Elastic support band 16 may be said to secure or aid in the positioning of under-bust cradle 14, such that under-bust cradle 14 substantially remains in its desired position where at least some of under-bust cradle 14 is positioned inferior to the wearer's breasts while garment 10 is worn because elastic support band 16 helps to keep under-bust cradle 14 in place.

Thus, elastic support band 16 may be said to be configured to provide support and lift, even for larger size breasts (e.g., D-cup and larger), by providing positioning and a foundation for under-bust cradle 14, and thereby a foundation for left and right breast cups 18, 20. Because elastic support band 16 extends about the circumference of the wearer's torso (and the circumference of bodice system 12), elastic support band 16 also is configured to secure garment 10 in the back (e.g., along posterior side 8 of garment 10) so that garment 10 does not ride-up the wearer's back. Nonetheless, elastic support band 16 generally has an elasticity sufficient to allow for garment 10 to be stretched to be donned in a pull-on fashion, when an appropriate size is provided for a given wearer. For example, elastic support band 16 is chosen to have elasticity sufficient to allow a wearer to pull garment 10 on over the wearer's head and breasts, so that the breasts can then be arranged and positioned within left and right breast cups 18, 20, without having to adjust straps or hardware, and without having to close or secure bodice system 12 about the wearer's body with clasps or closures.

Left breast cup 18 and right breast cup 20 may be constructed of at least three pieces that are shaped and contoured to create a full, rounded breast shape, and may be configured to reduce or prevent fabric bunching and/or pointiness in the cups. The example of FIGS. 1-2 includes three breast cup pieces in each of left breast cup 18 and right breast cup 20, though other examples of bodice system 12 may include additional or fewer breast cup pieces. The use of at least three pieces in left and right breast cups 18, 20 may enable more flexibility in a three-dimensional shape and volume provided by left and right breast cups 18, 20. In this example, each of left breast cup 18 and right breast cup 20 includes a lateral piece 44, a medial piece 46, and a superior piece 48, each of which may be formed of one or a plurality of layers of material. The breast cup pieces 44, 46, 48 of left and right breast cups 18, 20 are generally complementarily sized, shaped, and contoured with respect to one another such that they fit, or nest, together to form the three-dimensional shape and volume of left and right breast cups 18, 20. Lateral piece 44 may be coupled to medial piece 46 such that medial piece 46 is positioned medially to lateral piece 44 when garment 10 is worn. Similarly, superior piece 48 may be coupled to lateral piece 44 and medial piece 46 such that superior piece 48 is positioned superiorly to lateral piece 44 and medial piece 46 when garment 10 is worn, though portions of superior pieces 48 also may be medial to medial piece 46, as shown in FIG. 1.

Superior piece 48 may be arranged or oriented at an angle, extending obliquely across a respective breast of the wearer when garment 10 incorporating bodice system 12 is worn. Each superior piece 48 may extend from a respective armhole 64, 66 medially to a respective medial piece 46, and may terminate at or near a centerline 65 of bodice system 12. As further shown in FIG. 1, under-bust cradle 14 (e.g., superior edge 34) may extend along the entire left breast root seam 36 and the entire right breast root seam 38 such that under-bust cradle 14 is coupled to lateral piece 44, medial piece 46, and superior piece 48 of each of left breast cup 18 and right breast cup 20. Superior pieces 48 may be sized, shaped, contoured, and formed of materials such that superior pieces 48 are configured to encourage or create a desired neckline for full, voluminous, rounded shape and cleavage in the wearer's breasts. Each lateral piece 44 may extend superiorly from a respective breast root seam 36, 38, to a cup bust point 70 of each breast cup 18, 20. Each medial piece 46 may extend superiorly from a respective breast root seam 36, 38 to cup bust point 70 of each breast cup 18, 20 as well.

Left breast cup 18 and right breast cup 20 each may include one or more seams extending between the respective pieces of the breast cups, which may be said to define the extent of each piece of the respective breast cups, and/or serve to couple the respective pieces together to form each breast cup 18, 20. In the example of FIGS. 1-2, each of left breast cup 18 and right breast cup 20 includes an obliquely-extending overbust seam 56 and a vertically-extending seam 58. Obliquely-extending overbust seam 56 may be curved and may extend along an inferior edge 60 of each superior piece 48, from a lateral edge 62 of each superior piece 48 along a left and right armhole opening 64, 66, respectively, to a medial edge 68 of each superior piece 48, adjacent to or at left and right breast root seam 36, 38, respectively. In other words, obliquely-extending overbust seams 56 generally extend diagonally across the wearer's breasts from armhole openings 64, 66, traveling inferiorly and medially across left and right breast cups 18, 20. The curved or contoured nature of obliquely-extending overbust seam 56 may contribute to projection and roundness enabled by left and right breast cups 18, 20. Obliquely-extending overbust seams 56 may serve to couple superior piece 48 to lateral piece 44 and medial piece 46 in each breast cup 18, 20.

Vertically-extending seams 58 may extend substantially vertically (though may be curved or contoured) between lateral piece 44 and medial piece 46 of each breast cup 18, 20, and may serve to couple lateral piece 44 to medial piece 46 in each breast cup 18, 20. Each vertically-extending seam 58 may intersect a respective obliquely-extending overbust seam 56 at a respective cup bust point 70 of each respective breast cup 18, 20, which is configured to be the fullest point of projection of each breast cup 18, 20. Each vertically-extending seam 58 also may intersect a respective breast root seam 36, 38. Obliquely-extending overbust seams 56 and/or vertically-extending seams 58 may be curved to create contours, thereby being configured to create roundness in and contribute to projection of the wearer's breasts.

Left curved sling 26 and right curved sling 28 are configured to work with left breast cup 18 and right breast cup 20, respectively, along with left and right shoulder straps 22, 24, to lift, shape, and support the wearer's breasts by urging the wearer's breasts upwards from under-bust cradle 14, in medial and superior directions. Left and right curved slings 26, 28 may be formed of non-stretch or low-stretch material (e.g., non-elastic textiles, or textiles with little to no elasticity), and interconnected with other components of bodice system 12, to help lift the wearer's breasts superiorly from the base of support provided by under-bust cradle 14. As described herein, the shape, placement, and material selection of left and right curved slings 26, 28, along with how left and right curved slings 26, 28 are attached to the rest of bodice system 12, contribute to creating the desired lifting of the wearer's breasts. For example, left curved sling 26 is sized and positioned to overlap with at least a portion of lateral piece 44, medial piece 46, and superior piece 48 of left breast cup 18, while right curved sling 28 is sized and positioned to overlap with at least a portion of lateral piece 44, medial piece 46, and superior piece 48 of right breast cup 20. As used herein, left curved sling 26 and right curved sling 28 may be said to "overlap" the pieces of breast cups 18, 20, even in examples where left curved sling 26 and right curved sling 28 are positioned between respective layers of left breast cup 18 and right breast cup 20, and even in examples where left curved sling 26 and right curved sling 28 overlie or underlie the pieces of left breast cup 18 and right breast cup 20 when garment 10 is worn. Thus, left and right curved slings 26, 28 are said to overlap one or more layers of a given piece of left or right breast cup 18, 20 when they occupy some of the same area of the respective breast cup 18, 20, regardless of whether the respective curved sling 26, 28 is positioned on top of, underneath, or between the particular layers of those areas of the respective breast cup 18, 20.

Left curved sling 26 and right curved sling 28 are generally formed of a non-stretch textile configured to contribute to the support of the weight of larger size breasts provided by overall bodice system 12. In some examples, left curved sling 26 and right curved sling 28 are configured to achieve a lifted and rounded breast shape with a balance of fullness from top to bottom. Additionally or alternatively, left curved sling 26 and right curved sling 28 may be configured to convey the appearance of full breast volume or breast capacity by lifting the wearer's breasts and/or increasing the visible surface area of the wearer's breasts. Additionally or alternatively, left curved sling 26 and right curved sling 28 may be configured to prevent the wearer's breasts from spilling to lateral sides by lifting the wearer's breasts inwards (e.g., medially) and away from the wearer's armpits. Bodice system 12 also may be configured to create breast separation and evenness for the wearer's breasts, as opposed to conventional breast-supportive garments, which can unnaturally press the breasts too tightly together. These technical effects may be accomplished via placement, sizing, shaping, and material selection of left and right curved slings 26, 28, as disclosed herein, and within the overall context of incorporation of curved slings 26, 28 in the front-to-back support provided by disclosed bodice systems 12.

Left shoulder strap 22 is operatively coupled to left breast cup 18, extending superiorly up and over the wearer's left shoulder when garment 10 is worn. Similarly, right shoulder strap 24 is operatively coupled to right breast cup 20, extending superiorly up and over the wearer's right shoulder when garment 10 is worn. Shoulder straps 22, 24 help distribute weight of the wearer's breasts to the rest of bodice system 12 (e.g., to flexible back aligning member 30 and posterior portion 42 of elastic support band 16), such that bodice system 12 may be configured to provide even lift to the wearer's breasts from left breast cup 18 and right breast cup 20 along anterior/front side 6 of garment 10, and through the integrally-formed back aligning member 30. In other words, shoulder straps 22, 24 may be said to connect the lift and support provided by anterior side 138 of bodice system 12 to a posterior side 140 of bodice system 12. In this manner, left and right shoulder straps 22, 24 work together with left and right breast cups 18, 20 and left and right curved slings 26, 28 to help lift, shape, and support the wearer's breasts above the base provided by under-bust cradle 14. Each of left shoulder strap 22 and right shoulder strap 24 may be coupled to some or all of the layers of material forming left and right breast cups 18, 20, respectively, and/or to left and right curved slings 26, 28. While conventional shoulder straps of conventional garments allow for the wearers breasts to sag, and/or elongate the shape of the wearer's breasts, the shoulder straps 22, 24 of presently disclosed bodice systems 12 and garments 10 are configured to avoid these pitfalls, due to the supportive base provided by under-bust cradle 14 and the way that left and right shoulder straps 22, 24 interface with the other components of bodice system 12, as described herein.

Shoulder straps 22, 24 may be coupled directly to left and right breast cups 18, 20. For example, in some examples of bodice system 12, left and right shoulder straps 22, 24 extend from and/or are coupled to superior pieces 48 of left and right breast cups 18, 20, respectively. Additionally or alternatively, left shoulder strap 22 may be coupled to left curved sling 26, and right shoulder strap 24 may be coupled to right curved sling 28. Coupling left and right shoulder straps 22, 24 to left and right curved slings 26, 28, respectively, may help bodice system 12 to create a continuous line of lift from under-bust cradle 14 along left breast root seam 36 and right breast root seam 38, through left breast cup 18 and right breast cup 20, and to the wearer's overbust by holding up or supporting the upper portions of left and right curved slings 26, 28. In some examples, left and right curved slings 26, 28 are coupled to left and right shoulder straps 22, 24 along a respective superior sling edge 74 of each of curved slings 26, 28. Put another way, left shoulder strap 22 and right shoulder strap 24 may serve as a bridge between the lift provided by a front portion or side 138 of bodice system 12 (corresponding to anterior side 6 of garment 10) and a back portion or side 140 of bodice system 12 (corresponding to posterior side 8 of garment 10), because left shoulder strap 22 and right shoulder strap 24 serve to continue a lifting action over the wearer's shoulders and down through the wearer's back. While shoulder straps 22, 24 are illustrated as relatively thin or narrow straps in FIGS. 1-2, they may be configured to have a width sufficient to comfortably distribute the weight of the wearer's breasts, while preventing or reducing digging in to the wearer's shoulders. In some examples, shoulder straps 22, 24 may widen as they extend superiorly away from the wearer's breasts and towards the wearer's shoulders, which may provide a higher tensile strength and lift for a heavier load. Other styles of shoulder straps 22, 24 are also within the scope of the present disclosure, such as halter style shoulder straps, shoulder straps that cross each other in the front and/or back of bodice system 12, and/or shoulder straps that join in the back to form a racerback style back aligning member 30.

While some conventional breast-supportive garments provide shoulder straps that are adjustable in length via sliding an adjuster or clasp along the strap to adjust its length, such adjustable straps tend to "give" or settle over time, especially when supporting larger breast volumes or weights. Thus, disclosed garments 10 and bodice systems 12 may advantageously be provided with non-adjustable shoulder straps 22, 24, to increase comfort and support for the wearer's breasts, though shoulder straps 22, 24 may be made adjustable without departing from the scope of the present disclosure. Additionally or alternatively, in some examples, left shoulder strap 22 and right shoulder strap 24 are devoid of laterally extending seams within a respective superior region 72 of each of left shoulder strap 22 and right shoulder strap 24. In other words, each left and right shoulder straps 22, 24 may be constructed of one or more elongated layers of material that extend from left breast cup 18 and right breast cup 20, respectively, to flexible back aligning member 30.

As best seen in FIG. 2, flexible back aligning member 30 extends inferiorly from left shoulder strap 22 and right shoulder strap 24, and may be integrally formed, and/or continuous with left shoulder strap 22 and right shoulder strap 24. At least a portion of back aligning member 30 is directly coupled to elastic support band 16 along posterior portion 42 of elastic support band 16, though this coupling may occur only on the interior of garment 10 in some examples. As will be apparent to those of ordinary skill in the art, flexible back aligning member 30 is configured to be positioned against, or adjacent, the wearer's back when garment 10 is worn, such that at least a portion of the wearer's upper back, shoulders, and/or shoulder blades are covered by flexible back aligning member 30. Flexible back aligning member 30 may be configured to continue the support provided by under-bust cradle 14, elastic support band 16, left and right breast cups 18, 20, and shoulder straps 22, 24, such that bodice system 12 may provide front-to-back support for the wearer's breasts due to the synergistic effect of these components, their construction, and how they are interconnected. For example, at least one layer of flexible back aligning member 30 may be coupled to at least one layer of under-bust cradle 14 via side seams 31. This connection may be further supported by elastic support band 16, which generally extends at least substantially 360 degrees around the circumference of bodice system 12, being coupled to flexible back aligning member 30 along posterior side 140 of bodice system 12, and coupled to under-bust cradle 14 along anterior side 138 of bodice system 12.

Flexible back aligning member 30 is generally configured to be supportive and flexible such that garment 10 may be stretched and pulled onto and over the wearer's breasts, such that bodice system 12 and garment 10 as a whole may be devoid of hardware, such as clasps, closures, buckles, underwire, or other hardware. Bodice systems 12 and garments 10 thus may provide a flexible, comfortable garment, and avoid digging in to the wearer's body or flattening of the wearer's breasts while garment 10 is worn. While there are advantages to providing garments 10 and bodice systems 12 as disclosed herein without clasps, closures, adjustable straps, or other hardware, incorporating the same into such garments 10 and/or bodice systems 12 is within the scope of the present disclosure. Flexible back aligning member 30 is illustrated with a scooped neckline 50 in FIG. 2, though other examples of garment 10 may include varying shapes and contours of back aligning member 30 and are also within the scope of the present disclosure.

In some examples, bodice systems 12 and/or garments 10 incorporating the same include multi-width elasticated arrangements to provide a comfortable yet fitted bodice system 12 designed to provide the benefits described herein. For example, in addition to elastic support band 16, bodice system 12 may include a left elastic strip 76 extending along, or around, left armhole 64, and a right elastic strip 78 extending along, or around, right armhole 66 of garment 10. Left armhole 64 may be at least partially defined by a lateral edge region 80 of left shoulder strap 22 and a lateral edge region 82 of left breast cup 18. Similarly, right armhole 66 may be at least partially defined by a lateral edge region 84 of right shoulder strap 24 and a lateral edge region 86 of right breast cup 20. Left elastic strip 76 and right elastic strip 78 may be plush back elastic and/or may have an elastic modulus sufficient to provide optimal grip at armholes 64, 66 of garment 10/bodice system 12, to help support and lift larger size breasts. The width and elastic modulus of elastic support band 16 are typically greater than the width and elastic modulus of elastic strips 76, 78. In some examples, left elastic strip 76 at least substantially completely encircles left armhole 64, and right elastic strip 78 at least substantially completely encircles right armhole 66. Additionally or alternatively, left and right elastic strips 76, 78 may each be formed of a respective substantially continuous circle of elastic, and may form bound edges for left and right armholes 64, 66, respectively.

Bodice system 12 also may include a second elastic strip 88 (FIG. 2) that extends along, or within, a superior edge region 90 of back aligning member 30. Second elastic strip 88 may also continue along a medial edge region 92 of left shoulder strap 22, and along a medial edge region 94 of right shoulder strap 24 and may serve to help keep shoulder straps 22, 24 in place on the wearer's shoulders. Second elastic strip 88 may be narrower in width and/or lighter in strength than left elastic strip 76 of left armhole 64 and right elastic strip 78 of right armhole 66 (e.g., may have a lower elastic modulus). Second elastic strip 88 may be configured to provide modest and discreet grip and hold against the wearer's body. The wider and/or stronger elastic strips 76, 78 may be configured to help prevent the wearer's breasts from spilling to the lateral sides of bodice system 12, and/or may help to reinforce lift from shoulder straps 22, 24 from the front and back of bodice system 12. On the other hand, the narrower and/or lighter strength second elastic strip 88 may be positioned or included strategically in areas to balance support with comfort, and may help to reinforce support and flexibility of bodice system 12. In some examples, left and right elastic strips 76, 78 may be positioned interiorly to an inner layer 100 of bodice system 12 and may thus be visible when bodice system 12 is turned inside out, while second elastic strip 88 may be sandwiched between layers, hidden within bodice system 12. For example, second elastic strip 88 may be inserted or sewn in between an interior layer 162 (FIG. 7) and an exterior layer 164 of back aligning member 30.

Garments 10 and bodice systems 12 may be formed of a wide variety of fabrics and/or textiles, and generally include a combination of stretch and non-stretch materials. As used herein, "non-stretch" materials or textiles may include textiles with low stretch (e.g., low elasticity) or substantially no stretch (e.g., substantially no elasticity). For example, suitable non-stretch textiles may elastically stretch under a tensile load by less than 10% of their original length, less than 5% of their original length, less than 2% of their original length, and/or less than 1% of their original length. As used herein, examples of suitable stretch fabrics may include a percentage of elastane (e.g., Spandex®) or other elastic fiber or fabric, such as at least 1% elastane, at least 2% elastane, at least 3% elastane, at least 4% elastane, at least 5% elastane, at least 10% elastane, and/or at least 15% elastane. Additionally or alternatively, suitable examples of soft stretch fabrics may be imparted stretch characteristics due to their knit or weave.

In general terms, left and right breast cups 18, 20 may include inner and outer layers 100, 102 of one or more soft stretch fabrics, and may include a middle or interior layer 104, of a stretch textile (e.g., stretch mesh). The soft stretch fabric or fabrics may be chosen to be flexible and breathable, drape well, and be comfortable and non-irritating to the wearer's skin and/or nipples. The stretch mesh textile or textiles may be chosen among flexible, breathable, and comfortable mesh or other textiles that may be configured to provide support and shape to wearer's breasts without restricting movement. One or more pieces of left breast cup 18 and right breast cup 20 may include a lace fabric, such as superior pieces 48, as shown in FIG. 1. In other examples of bodice system 12, superior pieces 48 may be formed of a non-lace fabric, which may be the same or different as the soft stretch fabric used for medial and lateral pieces 46, 44 of left and right breast cups 18, 20. In some examples, material for superior pieces 48 may be selected so as not to flatten or press in to the wearer's breasts, thereby contributing to the shaping and fullness supported by bodice system 12. Fabric choices for different layers of bodice system 12, and how they are combined and assembled together, contribute to the functionality and performance of disclosed bodice systems 12 and garments 10.

As noted above, left curved sling 26, right curved sling 28, and at least a portion of under-bust cradle 14 (e.g., inner cradle layer 124) generally are formed of a non-stretch textile, such as a non-stretch mesh (e.g., Marquisette). While left and right curved slings 26, 28 and under-bust cradle 14 are still formed of a flexible material in examples of bodice system 12, the non-stretch or less stretchy nature of these components helps to provide more structure and stability to create the foundation for support and lift provided by disclosed bodice systems 12, even for larger size breasts. While this "shelf" effect from under-bust cradle 14 may be configured to help to prevent or reduce sagging in the wearer's breasts, it is configured to do so without interfering with the wearer's comfort. To this end, the non-stretch textile or textiles may be chosen to be a breathable mesh or other textile that may be configured to promote breast lift, shape, support, separation, and evenness without the need for underwire or hardware in the construction of bodice system 12. Marquisette or other suitable non-stretch textiles may be made with many natural or synthetic yarns, with non-limiting examples including nylon, cotton, silk, rayon, orlon, and polyester, and/or combinations thereof.

In examples of garment 10 including a skirt 32, skirt 32 generally is formed of a soft stretch fabric selected for flattering or attractive draping and wearer's comfort when garment 10 is worn. In some examples, skirt 32 may be formed of one or more layers of the same soft stretch fabric used in left and right breast cups 18, 20, and/or in the outer layers of under-bust cradle 14 and/or back aligning member 30. In examples of garment 10 including skirt 32, skirt 32 may be any desired shape, silhouette, and/or length. For example, in FIGS. 1-2, skirt 32 extends inferiorly from under-bust cradle 14 to an inferior skirt edge 96. Said inferior skirt edge 96 may be distal to the wearer's navel, distal to the wearer's waist, distal to the wearer's hips, distal to the wearer's buttocks, and/or distal to the wearer's mid-thigh. Skirt 32 may transition smoothly from bodice system 12. Skirt 32 may be formed of at least one layer of soft stretch fabric that is comfortable, breathable, and soft to the touch, while ideally delivering some opacity so that the skirt isn't sheer and all-exposing. Though various examples of garment 10 may include a skirt 32 formed of sheer or semi-transparent material without departing from the scope of the present disclosure.

FIGS. 1-2 illustrate an example of bodice system 12 integrated into garment 10 in the form of a nightwear garment (sometimes referred to as a "nightie"), though disclosed bodice systems 12 may be integrated into a garment 10 in the form of a bra, a bra top, a corset, swimwear, a swim top, a single-piece swim top, a one-piece swimsuit, a top, a crop top, a blouse, a shirt, a camisole, a sports bra, a sports top, an athletic top, intimate apparel, nightgowns, nightwear, sleepwear, pajamas, lingerie, night shirts, negligees, teddies, chemises, camisoles, loungewear, and/or a dress or other types of garments. That is, garments 10 may comprise more elements than the elements, including optional elements, of bodice system 12 disclosed herein. For example, garments 10 may include such elements as sleeves, front panels, rear panels, side panels, a peplum, and/or various other traditional or non-traditional garment elements. In addition, in some such garments 10, one or more components of bodice systems 12 may be generally hidden from view when garment 10 is donned by a wearer.

As represented in FIG. 1 and as described herein, the various elements of bodice systems 12 and garments 10 may be described in terms of relative positions to each other when garment 10 is donned by a wearer, when the wearer is standing vertically, and from the perspective of the wearer. Accordingly, when describing a first element as being left or right of a second element, the first element is further away along the lateral span of the garment 10 in the respective direction from centerline 65 that generally bisects bodice system 12; however, the first element is not necessarily directly to the left or right of the second element along a horizontal vector. Similarly, the terms above, below, upper, lower, front, behind, and similar terms relate to garment 10 when donned by the wearer standing vertically and from the perspective of the wearer. Accordingly, when describing a first element as being above or below a second element, the first element falls in a horizontal plane that is above or below a horizontal plane in which the second element falls, but the first element is not necessarily directly above or below the second element along a vertical vector. Garments 10 and bodice systems 12 additionally or alternatively may be described in terms of relative directions associated with a wearer's body when a garment 10 is donned, such as in terms of being superior (upward, or closer, to the wearer's head, as indicated by arrow 166), inferior (below, or closer, to the wearer's feet, as indicated by arrow 168), medial (inward, or closer, to or towards centerline 65, as indicated by arrows 170), lateral (left or right, or further out or away, from centerline 65, as indicated by arrows 172), posterior (rearward or back), and anterior (forward or front).

Additionally, an "edge" of an element of garments 10 or bodice systems 12, as used herein, additionally or alternatively may be referred to as, or described as, an edge region, a margin, or a boundary of the element, and an "edge" is not necessarily the absolute two-dimensional terminus of the element. For example, as typical in garment construction, seams may have a width to them and the region associated with a seam may be considered the edge of the element. Moreover, two panels of material being secured together at a seam often are not perfectly aligned along their terminuses. Moreover, a seam within an expanse of material may define an "edge" of a sub-portion of that expanse of material, with the sub-portion optionally being described as a "panel" of the material. In other words, two adjacent panels may in fact be constructed of the same piece of material with a seam or other structure defining an edge, or boundary, between the two adjacent panels.

Turning now to FIGS. 3-9, illustrative, non-exclusive examples of bodice systems 12 and/or components thereof are illustrated. Where appropriate, the reference numerals from the illustrations of FIGS. 1-2 are used to designate corresponding parts of bodice systems 12 in FIGS. 3-9, however, the examples of FIGS. 3-9 are non-exclusive and do not limit garments 10 or bodice systems 12 to the illustrated examples. That is, bodice systems 12 are not limited to the specific examples illustrated in FIGS. 3-9, and may incorporate any number of the various aspects, configurations, characteristics, properties, etc. that are illustrated in and discussed with reference to the representations of FIGS. 1-2 and/or the examples of FIGS. 3-9, as well as variations thereof, without requiring the inclusion of all such aspects, configurations, characteristics, properties, etc. For the purpose of brevity, each previously discussed component, part, portion, aspect, region, etc. or variants thereof, may not be discussed, illustrated, and/or labeled again with respect to each of FIGS. 3-9, however, it is within the scope of the present disclosure that the previously discussed features, variants, etc. may be utilized therewith.

Figure 3:
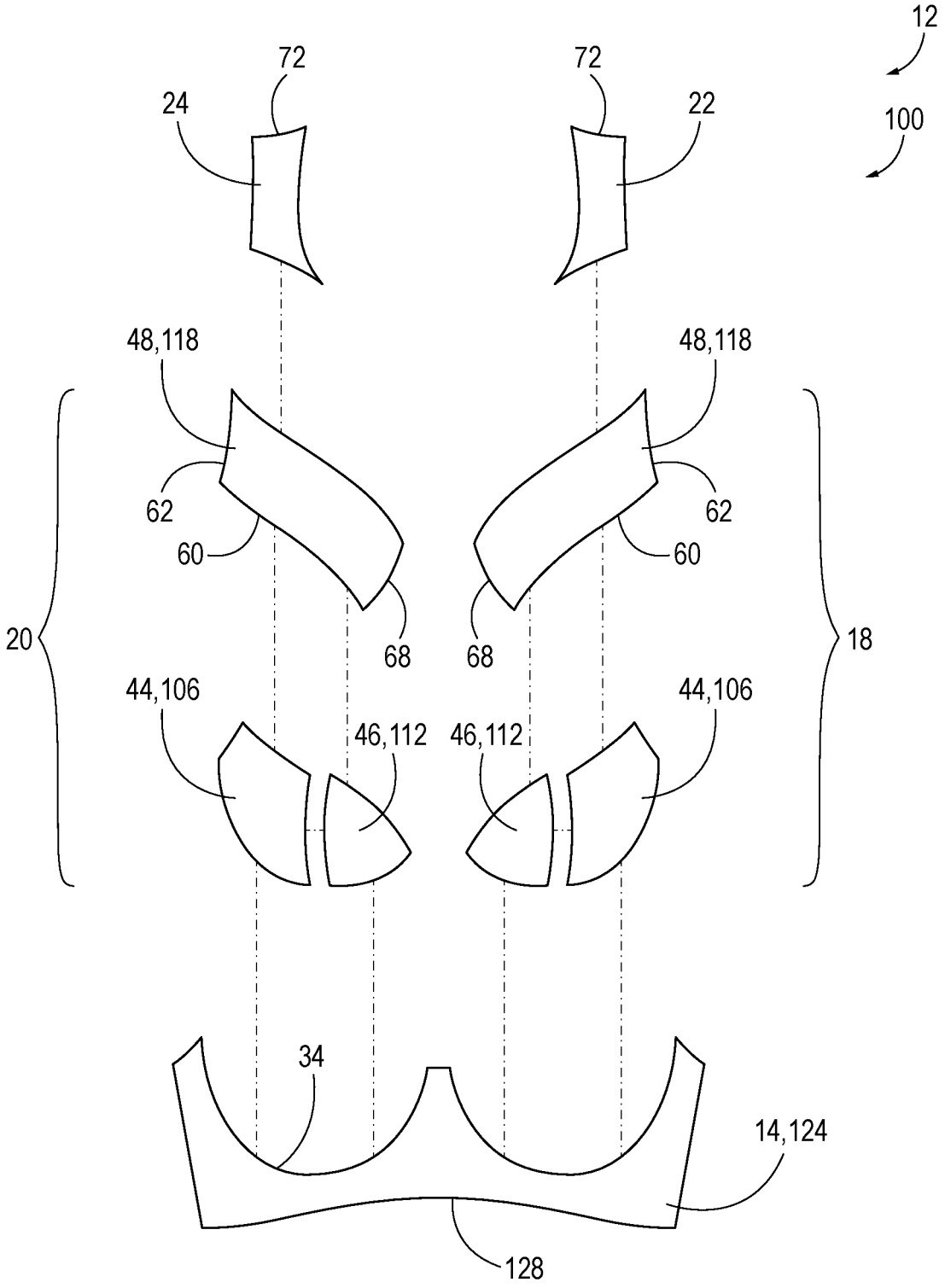
FIG. 3 is an exploded front elevation view of components of an inner layer of an example of presently disclosed bodice systems.
Figures 4, 5:
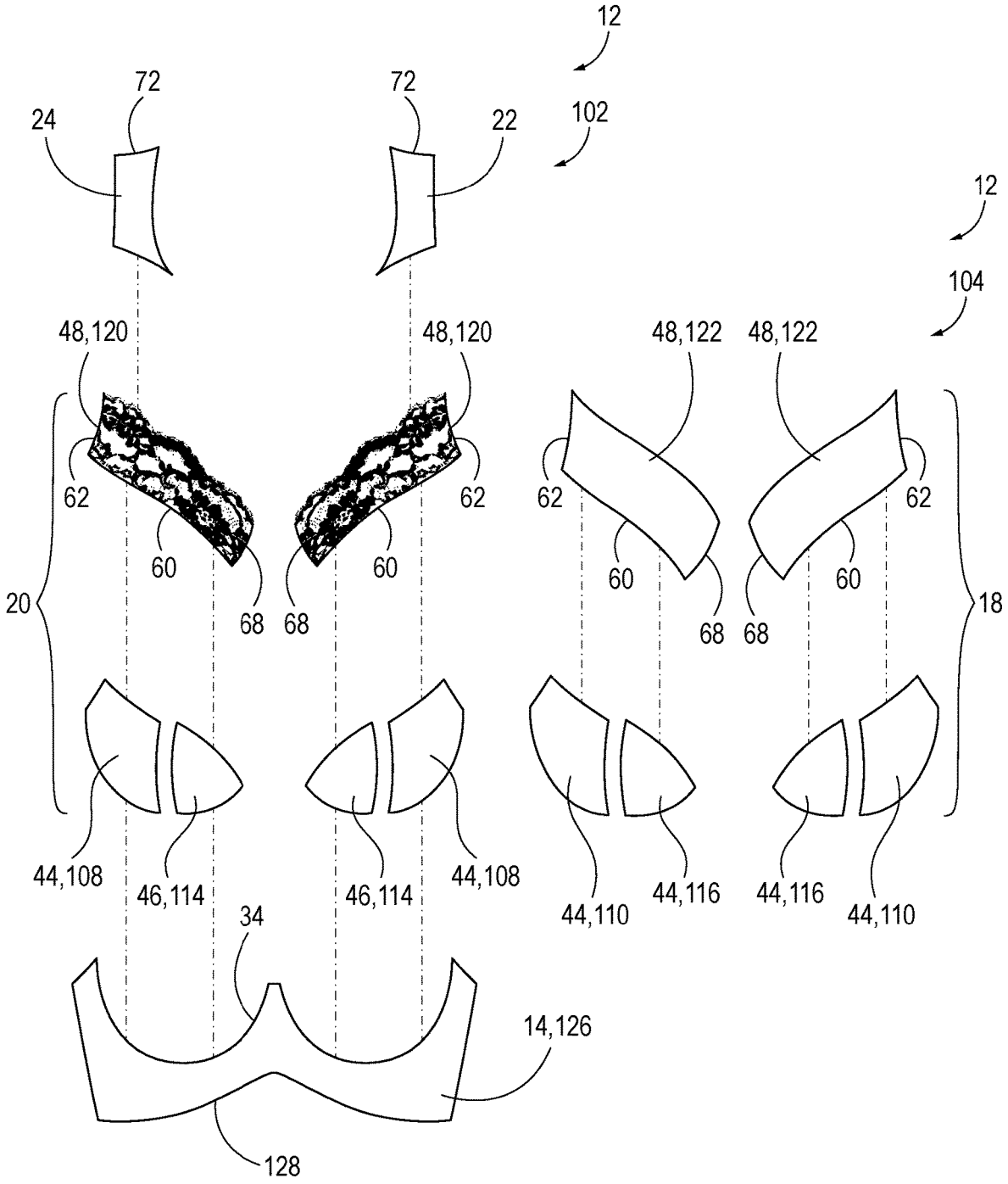
FIG. 4 is an exploded front elevation view of components of an outer layer of an example of presently disclosed bodice systems.
FIG. 5 is an exploded front elevation view of components of a middle layer of an example of presently disclosed bodice systems.
Figure 6:
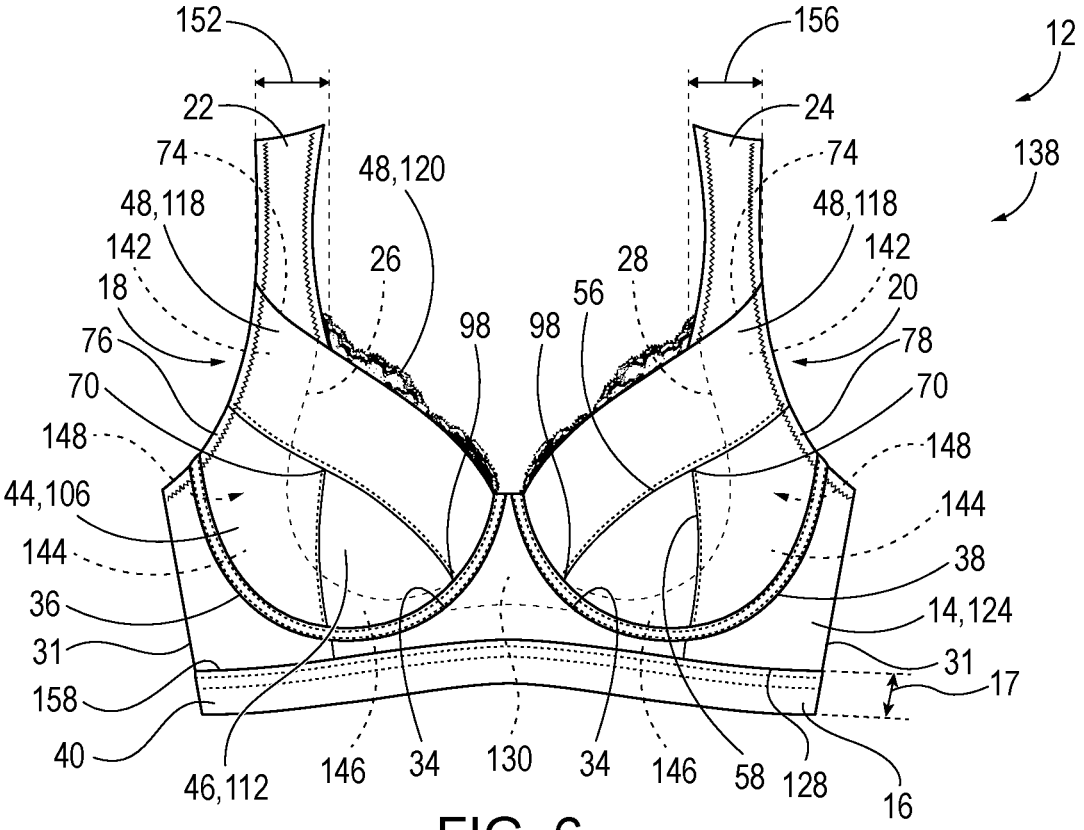
FIG. 6 is a front elevation view of an example of a bodice system according to the present disclosure, shown turned inside-out.
Figure 7:
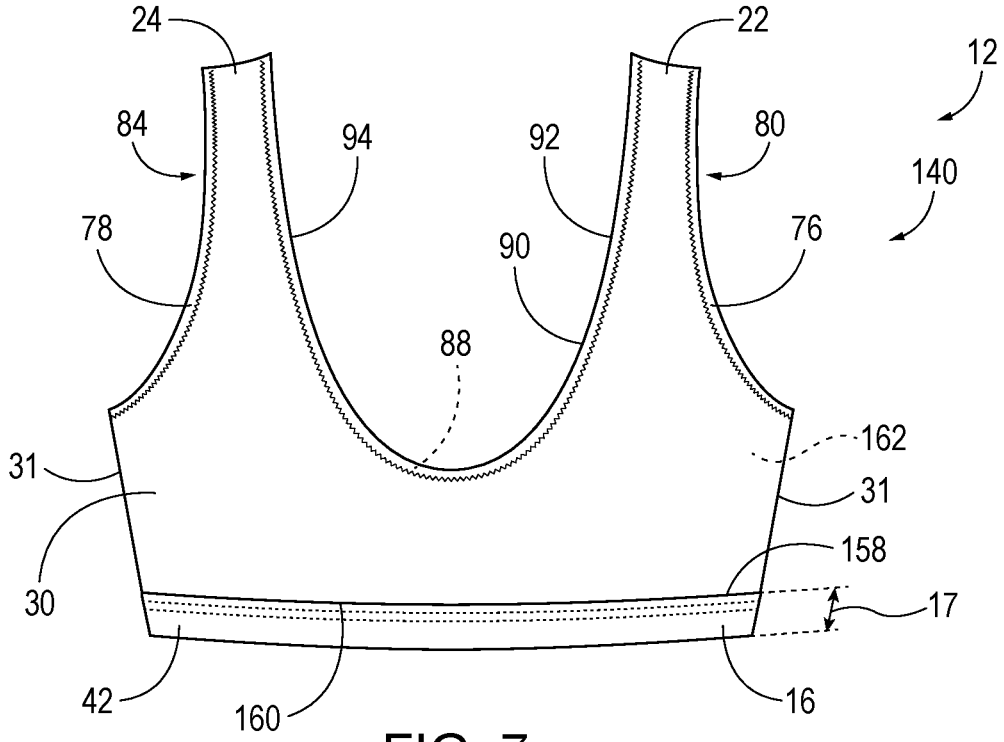
FIG. 7 is a back elevation view of the inside-out bodice system of FIG. 6.

FIGS. 3-5 illustrate exploded views of different layers that may be combined together to form the example of bodice system 12 shown in FIGS. 6-7. In other examples, more or fewer layers may be used to form one or more components of bodice system 12 than is shown in FIGS. 3-5. FIG. 3 illustrates an inner layer 100 of an example of a portion of bodice system 12, FIG. 4 illustrates an outer layer 102 of an example of a portion of bodice system 12, and FIG. 5 illustrates a middle layer 104 of an example of a portion of bodice system 12. Generally, inner layer 100 is configured to be positioned against and/or facing the wearer's body when garment 10 is worn, outer layer 102 is configured to face away from the wearer's body when garment 10 is worn, and middle layer 104 is sandwiched between inner layer 100 and outer layer 102. As shown in in FIGS. 3-5, each of left breast cup 18 and right breast cup 20 may include an inner layer, an outer layer, and a middle layer sandwiched between the outer layer and the inner layer. In this framework, lateral piece 44 of each of left breast cup 18 and right breast cup 20 may include a first lateral piece 106 of inner layer 100, a second lateral piece 108 of outer layer 102, and a third lateral piece 110 of middle layer 104. Similarly, medial piece 46 of each of left breast cup 18 and right breast cup 20 may include a first medial piece 112 of inner layer 100, a second medial piece 114 of outer layer 102, and a third medial piece 116 of middle layer 104. Superior piece 48 of each of left breast cup 18 and right breast cup 20 may include a first superior piece 118 of inner layer 100, a second superior piece 120 of outer layer 102, and a third superior piece 122 of middle layer 104.

In some examples of bodice system 12, one or more layers of under-bust cradle 14, left curved sling 26, outer layer 102 of left breast cup 18 (e.g., second medial piece 114 and second lateral piece 108 of left breast cup 18), middle layer 104 of left breast cup 18 (e.g., third medial piece 116 and third lateral piece 110 of left breast cup 18), and inner layer 100 of left breast cup 18 (e.g., first medial piece 112 and first lateral piece 106 of left breast cup 18) are all coupled together along left breast root seam 36. Similarly, one or more layers of under-bust cradle 14, right curved sling 28, outer layer 102 of right breast cup 20 (e.g., second medial piece 114 and second lateral piece 108 of right breast cup 20), middle layer 104 of right breast cup 20 (e.g., third medial piece 116 and third lateral piece 110 of right breast cup 20), and inner layer 100 of right breast cup 20 (e.g., first medial piece 112 and first lateral piece 106 of right breast cup 20) all may be coupled together along right breast root seam 38.

In some examples of bodice system 12, different layers of pieces 44, 46, 48 that form left and right breast cups 18, 20 may be formed from one or more different materials. In a representative, non-limiting example, first lateral pieces 106, first medial pieces 112, and/or first superior pieces 118 of inner layer 100 of each of left breast cup 18 and right breast cup 20 are formed of a first stretch fabric. Second lateral pieces 108 and/or second medial pieces 114 of outer layer 102 of each of left breast cup 18 and right breast cup 20 may be formed of a second stretch fabric, which may be the same or different material as the first stretch fabric from which first lateral pieces 106, first medial pieces 112, and/or first superior pieces 118 are formed. For example, the first and/or second stretch fabrics may be chosen from a variety of stretchable, or elastic, fabrics. In examples where the first and second stretch fabrics are not the same material, the first stretch fabric may be different from the second stretch fabric in terms of material composition, weight, thickness, insulation, and/or the degree or modulus of elasticity. In some examples of bodice system 12, first lateral pieces 106, first medial pieces 112, first superior pieces 118, second lateral pieces 108, and second medial pieces 114 of left and right breast cups 18, 20 all may be formed of a soft, stretch, breathable fabric, such as Modal. Other suitable examples for the first and second stretch fabrics can include stretch fabrics comprising rayon, elastane, jersey, cotton, lyocell, tencel, wool, silk, spandex, chiffon, jacquard, and/or combinations thereof. On the other hand, left and right curved slings 26, 28 (FIGS. 1, 6, and 8) may be formed of a non-stretch textile, such as a non-stretch mesh.

Second superior pieces 120 of outer layer 102 of left and right breast cups 18, 20 are formed of a soft stretch fabric that is the same as or similar to the first and second stretch fabrics described above, in some examples. In some examples, second superior pieces 120 may be formed of a different material, such as a lace material, which may be a stretch lace fabric. Said lace fabric may be selected such that second superior pieces 120 are configured such that they do not flatten or smash down the wearer's overbust region, and/or may be selected for aesthetic considerations. Additionally or alternatively, second superior pieces 120 may be formed without elastic strips, which may help to avoid a heavily compressed appearance along the top of the wearer's breasts (overbust) when garment 10 is worn, and may contribute to the appearance of full, round, supple-looking breasts.

Third medial pieces 116, third lateral pieces 110, and/or third superior pieces 122 of middle layer 104 of left breast cup 18 and right breast cup 20 may be formed of a first stretch textile, such as a stretch mesh textile. The stretch textile may be breathable and/or optionally may be a four-way stretch mesh. Such four-way stretch mesh materials may be configured to move with the wearer's breasts to contribute to natural shaping and roundness of the breasts, in contrast to foam cups or layers used in conventional breast-supportive garments which holds its shape such that it is more structured, less flexible, and masks the natural look of the wearer's breasts. Other examples of suitable stretch textiles may be two-way stretch meshes or other two-way stretch textiles. Suitable stretch textiles may help to enable a rounded shape in left and right breast cups 18, 20 and/or in the wearer's breasts when garment 10 is worn and/or in contouring the shape of left and right breast cups 18, 20 because it tends to conform to and move with the wearer's body.

In general, garments 10 and/or bodice systems 12, and various subcomponents, or elements, thereof, may be constructed of various suitable materials, with illustrative non-exclusive examples including cotton, silk, satin, spandex, latex, microfiber, lace, polyester, nylon, polybutylene terephthalate (PBT), polyester PBT, polyester spandex blend, cotton-poly-spandex knit, tricot knit, raschel knit, jersey knit, silk and spandex blend, mesh, etc., and any suitable combination thereof, which may be used to form the desired materials with the desired characteristics (e.g., stretch, non-stretch, breathability, softness, etc.) for the various components of disclosed bodice systems 12.

Under-bust cradle 14 may include at least an inner cradle layer 124 (FIG. 3) and an outer cradle layer 126 (FIG. 4). Inner cradle layer 124 is typically formed of a non-stretch textile, such as a non-stretch mesh, and serves to stabilize bodice system 12 against the wearer's body and adds stability and structure to bodice system 12 due in part to its non-stretch nature and in part to the way it is coupled to other components of bodice system 12. Outer cradle layer 126 may simply be a soft stretch fabric selected for comfort and appearance, as it plays a lesser role in the function of bodice system 12 in some examples. Inner cradle layer 124 and outer cradle layer 126 may be coupled together along superior edge 34 of under-bust cradle 14. On the other hand, inner cradle layer 124 and outer cradle layer 126 are not coupled together along an inferior edge 128 of under-bust cradle 14 in some examples. This arrangement may help to provide a smoother and/or more attractive draping of outer cradle layer 126 and skirt 32 (if included) over the wearer's body. Thus, inferior edge 128 of outer cradle layer 126 may be coupled to one or more layers of skirt 32, but may be otherwise free to move with respect to other layers of bodice system 12. Inferior edge 128 of inner cradle layer 124 may be coupled to elastic support band 16 (though notably inferior edge 128 of outer cradle layer 126 may be detached from, or uncoupled to elastic support band 16).

While FIGS. 1-2 illustrate examples of garment 10 and incorporated bodice system 12 viewed from the outer, or exterior, side of the garment/bodice system, FIGS. 6-7 illustrate an example of bodice system 12 shown from the inner, or interior, side of bodice system 12. In other words, FIGS. 6-7 illustrate a representative example of bodice system 12 viewed inside-out. FIG. 6 shows an anterior side 138 of bodice system 12, while FIG. 7 shows posterior side 140 of bodice system 12. These views illustrate how the various components illustrated in FIGS. 3-5 are pieced together to form disclosed bodice systems 12. As shown in FIG. 6, left and right curved slings 26, 28 may be positioned relative to the pieces of left and right breast cups 18, 20 such that left and right curved slings 26, 28 overlap or coincide with at least a portion of one or more pieces of left and right breast cup 18, 20, respectively. For example, a first portion 142 of left curved sling 26 may be positioned between first superior piece 118 and third superior piece 122 of left breast cup 18, though third superior piece 122 corresponds to a middle layer of bodice system 12 in some examples, and is not visible in FIG. 6, which shows bodice system 12 inside out such that the inner, first superior piece 118 is visible and third superior piece 122 is hidden. A second portion 144 of left curved sling 26 may be positioned between first lateral piece 106 and third lateral piece 110 (FIG. 5) of left breast cup 18. A third portion 146 of left curved sling 26 may be positioned between first medial piece 112 and third medial piece 116 of left breast cup 18. Similarly, first portion 142 of right curved sling 28 may be positioned between first superior piece 118 and third superior piece 122 of right breast cup 20, second portion 144 of right curved sling 28 may be positioned between first lateral piece 106 and third lateral piece 110 of right breast cup 20, and third portion 146 of right curved sling 28 may be positioned between first medial piece 112 and third medial piece 116 of right breast cup 20. In other examples of bodice system 12, curved slings 26, 28 may be positioned between middle and outer layers 104, 102 of left and right breast cups 18, 20, rather than between inner and middle layers 100, 104. In yet other examples of bodice system 12, curved slings 26, 28 may be positioned interiorly to inner layer 100 (FIG. 3) and/or exteriorly to outer layer 102 (FIG. 4), in addition to or instead of being sandwiched between layers of breast cups 18, 20. In some examples, curved slings 26, 28 themselves may include two or more layers of material.

Left curved sling 26 and right curved sling 28 may be positioned relative to the wearer's breasts at least partially via under-bust cradle 14 and elastic support band 16. For example, elastic support band 16 and under-bust cradle 14 may be configured to work together to position bodice system 12 on the wearer's body. A portion of left and right curved slings 26, 28 may be coupled to, and/or coincide with left and right breast root seams 36, 38, respectively. Superior edge 34 of under-bust cradle 14 also may be coupled to left and right breast root seams 36, 38, which in turn enables the position of under-bust cradle 14 to at least partially dictate the position of left and right curved slings 26, 28, via the connection of these components to each other. Left curved sling 26 and right curved sling 28 also may intersect a cradle reinforcement tab 130 of under-bust cradle 14 in some examples, which can help to create a substantially continuous line of hold and support along left breast root seam 36 and right breast root seam 38 of bodice system 12, because cradle reinforcement tab 130 may extend between left breast root seam 36 and right breast root seam 38, effectively reinforcing the connection between left breast cup 18 and right breast cup 20.

Figure 8:
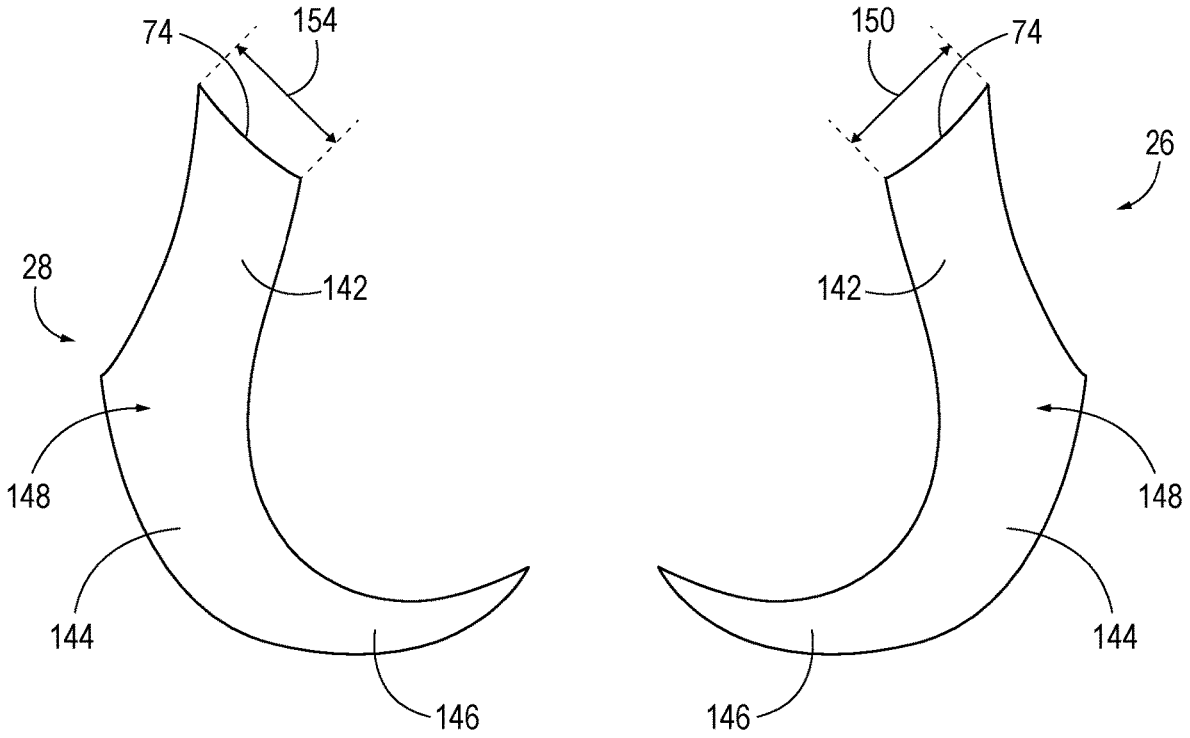
FIG. 8 is a front elevation view of an example of left and right curved slings of presently disclosed bodice systems.

Left curved sling 26 and right curved sling 28 may vary in width such that they are configured to deliver or create continuous lift of the wearer's breasts along the length of the curved slings 26, 28 towards the respective cup bust point 70 of left breast cup 18 and right breast cup 20. For example, curved slings 26, 28 may include wider and narrower portions, having curved edges and an overall substantially J-shaped form, as best seen in FIG. 8, which illustrates an example of left curved sling 26 and right curved sling 28 shown isolated from the rest of bodice system 12 for clarity. The continuously varying degrees and angles of lift at different points along curved slings 26, 28 may correspond to areas where breast volume is greater or lesser, and where more or less lift and projection is required to allow for the wearer to achieve full and round-shaped breasts. For example, the lower portion of the J-shape of left and right curved slings 26, 28 adjacent left and right breast root seams 38, 36 may taper to get thinner near the medial portions of the wearer's breasts (e.g., within the area of medial portions 46 of left and right breast cups 18, 20) to facilitate the desired shaping of the visible portion of the wearer's breasts, while wider portions of left and right curved slings 26, 28 (e.g., within the areas of lateral portions 44 and superior portions 48 of left and right breast cups 18, 20) apply more force to the wearer's breasts to help urge them in superior and medial directions. The curve and varying widths of left and right curved slings 26, 28 help to create smooth integration of left and right curved slings 26, 28 into bodice system 12, as well as creating a substantially continuous area of lift along the length of left and right curved slings 26, 28, from the respective breast root seam 36, 38 to the respective shoulder strap 22, 24.

With reference to FIGS. 6 and 8, left curved sling 26 and right curved sling 28 each may have a respective region of maximum width 148. Region of maximum width 148 of left curved sling 26 may be positioned to overlap lateral piece 44 of left breast cup 18, adjacent superior piece 48 of left breast cup 18. Similarly, region of maximum width 148 of right curved sling 28 may be positioned to overlap lateral piece 44 of right breast cup 20, adjacent superior piece 48 of right breast cup 20. These regions of maximum width 148 may correspond to areas where the wearer's breast volume and weight is high, and where there may be a tendency for larger size breasts to collapse to the sides. Regions of maximum width 148 of left and right curved slings 26, 28 may be configured to urge the sides of the wearer's breasts away from the armpit of the wearer, and project them towards the high-point or cup bust point 70 of left and right breast cups 18, 20. The width of left and right curved slings 26, 28 may narrow slightly along the curve in superior piece 48 of each of left and right breast cups 18, 20, and continue to push the wearer's breasts towards the respective cup bust-point 70, thereby contributing to a roundness and fullness at the top of the breasts. Within respective areas of medial piece 46 of left and right breast cups 18, 20, the width of left and right curved slings 26, 28 may transition from wider to narrower along the curve, which may serve to lift the wearer's breasts up and away from the body of the wearer and up and away from under-bust cradle 14, towards the respective cup bust-point 70 of each of left and right breast cup 18, 20, while helping to prevent the wearer's breasts from collapsing at center front.

Lateral edges of curved slings 26, 28 may follow the contour of a respective lateral edge of superior piece 48, a respective lateral edge of lateral piece 44, and further extend along a respective breast root seam 36, 38. Each curved sling 26, 28 may extend inferiorly from adjacent a respective shoulder strap 22, 24, to a respective lateral piece 44, and then curve medially to and/or towards a respective medial piece 46. Additionally or alternatively, each of left and right curved sling 26, 28 may traverse a respective superior piece 48 lateral to a respective cup bust point 70, where the respective lateral piece 44 meets the respective medial piece 46. Lower portions of left and right curved slings 26, 28 may curve medially to or towards a meeting point 98 of the breast cups where superior piece 48, breast root seam 36 or 38, and medial piece 46 all meet. Additionally or alternatively, left and right curved slings 26, 28 may curve and extend such that they each overlap cradle reinforcement tab 130. The portion of left and right breast cups 18, 20 that is devoid of left and right curved slings 26, 28 may form a substantially teardrop shape in some examples, which can help avoid unnatural shaping of the wearer's breasts when garment 10 is worn.

Curved slings 26, 28 also may be sized and shaped to smoothly interface with other components of bodice system 12. For example, a first sling length 150 (FIG. 8) of superior sling edge 74 of left curved sling 26 may be at least substantially equal to a first strap length 152 of left shoulder strap 22, where left shoulder strap 22 is coupled to left curved sling 26. Similarly, a second sling length 154 of superior sling edge 74 of right curved sling 28 may be at least substantially equal to a second strap length 156 of right shoulder strap 24, where right shoulder strap 24 is coupled to right curved sling 28. Superior sling edges 74 of left and right curved slings 26, 28 may have a similar angle and/or curve as the lateral superior portions of superior pieces 48, such that curved slings 26, 28, superior pieces 48, and shoulder straps 22, 24 all may be complementarily shaped to interface with one another. Additionally or alternatively, the widths of left and right curved slings 26, 28 may be varied according to the wearer's breast size to deliver different amounts and levels of lift and projection, depending upon the wearer's breast volume. For example, the larger the wearer's breast size and breast volume, the larger the relative widths of left and right curved slings 26, 28 may be, to deliver a higher level and degree of breast lift and projection.

FIGS. 6-7 most clearly illustrate elastic support band 16 of bodice system 12. As best seen in FIG. 6, elastic support band 16 may be coupled to inner cradle layer 124 of under-bust cradle 14 along anterior portion 40 of elastic support band 16; and as best seen in FIG. 7, elastic support band 16 may be coupled to back aligning member 30 along the entire posterior portion 42 of elastic support band 16. Specifically, a superior edge 158 of elastic support band 16 may be coupled to inferior edge 128 of under-bust cradle 14 on anterior side 138 of bodice system 12, and superior edge 158 of elastic support band 16 may be coupled to inferior edge 160 of back aligning member 30 on posterior side 140 of bodice system 12. Elastic support band 16 has a support band width 17 that is sufficient to enable elastic support band 16 to provide the necessary or desired hold and structure for under-bust cradle 14 and bodice system 12 as a whole. For example, elastic support bands 16 that have too narrow a width 17 may be insufficient to prevent excessive movement of under-bust cradle 14 along the wearer's torso when garment 10 is worn. On the other hand, elastic support bands 16 that have too wide a width 17 may be uncomfortable, too constricting, or too stiff to allow garment 10 to be stretched over the wearer's head, shoulders, and breasts during donning. Depending on elastic selection, fabric selection in the rest of bodice system 12, and the needed support in a given size of bodice system 12, illustrative, non-limiting examples of elastic support bands 16 may have support band widths of at least 0.25 inches, at least 0.5 inches, at least 0.75 inches, at least 1 inch, at least 1.5 inches, at least 2 inches, at least 2.5 inches, and/or at least 3 inches.

In some examples, back aligning member 30 may include at least an interior layer 162 (FIG. 7) and an exterior layer 164 (FIG. 2). Interior layer 162 may be coupled to elastic support band 16 along posterior region 42 of elastic support band 16, thereby being configured to provide support to the wearer's breasts from a posterior side 8 of the garment. On the other hand, exterior layer 164 of back aligning member 30 is not coupled to elastic support band 16 in some examples. Interior layer 162 and exterior layer 164 of back aligning member 30 are only coupled along superior edge 90 of back aligning member 30 in some examples. Furthermore, in some examples of bodice system 12, interior layer 162 may be formed of a stretch textile, such as a stretch mesh, while exterior layer 164 may be formed of a soft stretch fabric (e.g., Modal), which may also be used to form skirt 32, outer layer 102 of left and right breast cups 18, 20, and/or other components of bodice system 12. This may enable aesthetic draping and a soft feel to exterior layer 164, while interior layer 162 may have more structure or rigidity, while still being stretchable and flexible, to help to anchor bodice system 12 and distribute the weight to support the wearer's breasts. Conventional breast-supporting garments often only attempt to provide support via the front sides of the garment, whereas presently disclosed bodice systems 12 and garments 10 incorporating the same are configured such that flexible back aligning member 30 also functions with anterior side 138 of bodice system 12 to create the lift and support provided by bodice system 12.

Figure 9:
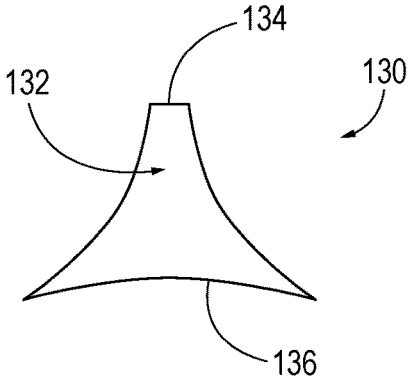
FIG. 9 is a front elevation view of an example of a cradle reinforcement tab of presently disclosed bodice systems.

With reference to FIG. 9, cradle reinforcement tab 130 of under-bust cradle 14 is shown isolated from under-bust cradle 14, for clarity. Cradle reinforcement tab 130 may be sandwiched between inner cradle layer 124 and outer cradle layer 126 in some examples of bodice system 12, with an example of relative positioning within bodice system 12 best seen in FIG. 6. Cradle reinforcement tab 130 may be configured to urge the wearer's breasts laterally away from centerline 65 of bodice system 12. Cradle reinforcement tab 130 may be formed of a non-stretch textile (e.g., a non-stretch mesh), which may be the same or different material as used for inner cradle layer 124. As best seen in FIG. 6, cradle reinforcement tab 130 may be positioned such that at least a portion of cradle reinforcement tab 130 is medial to each of left breast cup 18 and right breast cup 20, with said portion being indicated generally at 132 in FIG. 9. Additionally or alternatively, cradle reinforcement tab 130 may abut superior piece 48 and/or medial piece 46 of each of left breast cup 18 and right breast cup 20 (FIG. 6 illustrates cradle reinforcement tab 130 abutting both superior piece 48 and medial piece 46 of left and right breast cups 18, 20).

With continued reference to FIG. 9, cradle reinforcement tab 130 extends from a superior tab edge 134 to an inferior tab edge 136. When included in disclosed bodice systems 12, cradle reinforcement tab 130 may be sized and positioned relative to the other layers of under-bust cradle 14 such that inferior tab edge 136 is spaced apart from and superior to elastic support band 16. In other words, while inferior edge 128 of inner cradle layer 124 is coupled to elastic support band 16, inferior tab edge 136 is not coupled to elastic support band 16 in some examples, because cradle reinforcement tab 130 does not extend inferiorly to elastic support band 16. In other examples of bodice system 12, inferior tab edge 136 may extend to and be coupled to elastic support band 16 and/or may extend to inferior edge 128 of under-bust cradle 14. Superior tab edge 134 may be substantially collinear with a portion of superior edge 34 of under-bust cradle 14 in some examples. Cradle reinforcement tab 130 may be configured to reinforce under-bust cradle 14, such as by reducing separation of left and right breast cups 18, 20 when garment 10 is worn, by virtue of being formed of a non-stretch textile and connecting left and right breast cups 18, 20. Additionally or alternatively, cradle reinforcement tab 130 may be configured to function to help to urge the wearer's breasts away from centerline 65 of bodice system 12 (FIG. 1) and/or to reduce or prevent the wearer's breasts from drooping towards centerline 65, which may be accomplished via the structure and/or non-stretch nature of cradle reinforcement tab 130, and/or its placement between left and right breast cups 18, 20 and the connection between cradle reinforcement tab 130 and left and right breast root seams 36, 38.

Figure 10:
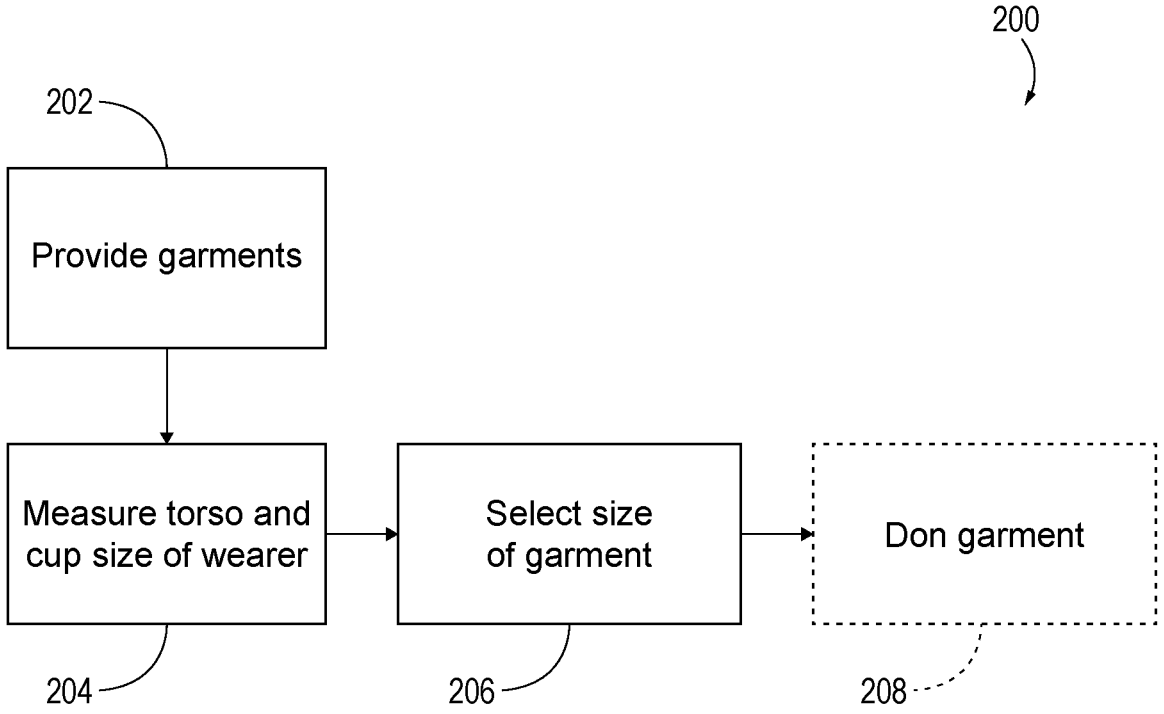
FIG. 10 is a schematic flowchart diagram representing methods according to the present disclosure.

FIG. 10 schematically provides a flowchart that represents illustrative, non-exclusive examples of methods 200 according to the present disclosure, though not all methods 200 according to the present disclosure are required to include all of the steps illustrated. The methods and steps illustrated in FIG. 10 are not limiting and other methods and steps are within the scope of the present disclosure, including methods having greater than or fewer than the number of steps illustrated, as understood from the discussions herein.

Methods 200 generally include providing a plurality of disclosed garments 10 and/or bodice systems 12 at 202, with said garments and/or bodice systems being provided in different size combinations that pair a band size of the elastic support band with a breast cup size of the left breast cup and the right breast cup. In other words, rather than providing garments or bodice systems in sizes such as Small, Medium, Large, etc., said garments and/or bodice systems may be sized in a manner akin to bra sizing, to allow for a more tailored fit for the torso circumference and breast volume of the wearer. Of course, garments and bodice systems sized within the Small/Medium/Large system are also within the scope of the present disclosure. Methods 200 also include measuring a torso circumference and a cup size of the wearer at 204 to select a size of garment 10 from among the plurality of the garments at 206. The respective breast cup sizes of the plurality of the garments and/or bodice systems may be configured to allow wearers to select between tighter and looser fits with respect to the measured cup size of the wearer. For example, the sizing may be provided in hybrid cup sizes such as C/D, D/DD, DD/DDD, DDD/E, E/F, F/G, and/or G/H, such that a wearer having a D-cup breast size could select the C/D garment or bodice system for a tighter fit, or the D/DD garment or bodice system for a looser fit. When garments are offered in smaller cup sizes, hybrid sizes additionally may include AAA/AA, AA/A, A/B, and/or B/C cup sizes. Similarly, hybrid cup sizes additionally or alternatively may be provided in larger cup sizes, such as H/I, IA J/K, K/L, and so on. Similarly, each band size may be offered with each hybrid cup size, to provide a wide range of fits for different body and breast sizes. In typical examples, the breast cup sizes may range from C-H-cups, though smaller and/or larger cup sizes may be provided, and the band sizes may range from approximately 30-40 inches in, for example, one inch or two inch increments, though a wider range of band sizes also may include smaller and/or larger band sizes provided at varying increments. In one example, the band sizes may include 30, 32, 34, 36, 38, and 40 inches, which refers to the overall length (e.g., circumference) of the elastic support band, though in some sizing examples, the listed band size may not correspond precisely to the measured wearer's torso circumference, as well understood in the art. The selected garment may be donned by the wearer at 208, such as by stretching the elastic support band over the wearer's head and shoulders to position the bodice system against the wearer's torso, and arranging the breasts within the left and right breast cups. The recommended donning step at 208 may include bending over, scooping the breasts, and lifting and placing the breasts within the left and right breast cups of the bodice system. Advantageously, some examples of garments/bodice systems do not require adjusting of any clasps, adjusters, or hardware during or after donning, which may increase comfort while wearing the garment, especially while sleeping, and/or increase the overall ease of use.

Illustrative, non-exclusive examples of inventive subject matter according to the present disclosure are described in the following enumerated paragraphs:

A1. A garment having a bodice system configured to provide lift, shape, and support to a wearer's breasts, the bodice system comprising:

an under-bust cradle, wherein at least a portion of the under-bust cradle is configured to be positioned inferior to the wearer's breasts when the garment is worn, wherein a superior edge of the under-bust cradle extends along a left breast root seam of a left breast cup and a right breast root seam of a right breast cup of the bodice system, wherein the left breast root seam and the right breast root seam are configured to be positioned along a breast root of the wearer when the garment is worn;

an elastic support band configured to extend circumferentially around the wearer's torso when the garment is worn, wherein an anterior portion of the elastic support band is coupled to and positioned inferior to the under-bust cradle, and wherein the elastic support band and the under-bust cradle together are configured to support the wearer's breasts;

the left breast cup and the right breast cup, wherein each of the left and right breast cups comprising a lateral piece, a medial piece, and a superior piece, wherein the lateral piece is coupled to the medial piece such that the medial piece is positioned medially to the lateral piece when the garment is worn, wherein the superior piece is coupled to the lateral piece and the medial piece such that the superior piece is positioned superiorly to the lateral piece and the medial piece when the garment is worn;

a left curved sling and a right curved sling, wherein each of the left curved sling and the right curved sling is configured to work with the left breast cup and the right breast cup, respectively, to lift, shape, and support the wearer's breasts by urging the wearer's breasts in medial and superior directions, wherein the left curved sling is sized and positioned to overlap with at least a portion of the lateral piece, the medial piece, and the superior piece of the left breast cup, and wherein the right curved sling is sized and positioned to overlap with at least a portion of the lateral piece, the medial piece, and the superior piece of the right breast cup;

a left shoulder strap coupled to the left breast cup and a right shoulder strap coupled to the right breast cup; and a flexible back aligning member extending inferiorly from the left shoulder strap and the right shoulder strap, wherein at least a portion of the flexible back aligning member is coupled to the elastic support band along a posterior portion of the elastic support band, wherein the flexible back aligning member is configured to be positioned adjacent the wearer's back when the garment is worn.

A2. The garment of paragraph A1, wherein the bodice system further comprises a skirt extending inferiorly from the under-bust cradle.

A3. The garment of any of paragraphs A1-A2, wherein each of the left breast cup and the right breast cup comprises an inner layer, an outer layer, and a middle layer sandwiched between the outer layer and the inner layer.

A3.1. The garment of any of paragraphs A1-A3, wherein the lateral piece of each of the left breast cup and the right breast cup comprises a first lateral piece of a/the inner layer, a second lateral piece of a/the outer layer, and a third lateral piece of a/the middle layer.

A3.2. The garment of any of paragraphs A1-A3.1, wherein the medial piece of each of the left breast cup and the right breast cup comprises a first medial piece of a/the inner layer, a second medial piece of a/the outer layer, and a third medial piece of a/the middle layer.

A3.3. The garment of any of paragraphs A1-A3.2, wherein the superior piece of each of the left breast cup and the right breast cup comprises a first superior piece of a/the inner layer, a second superior piece of a/the outer layer, and a third superior piece of a/the middle layer.

A3.4. The garment of any of paragraphs A1-A3.3, wherein an inner cradle layer of the under-bust cradle, an outer cradle layer of the under-bust cradle, the left curved sling, an/the outer layer of the left breast cup, a/the middle layer of the left breast cup, and an/the inner layer of the left breast cup are all coupled together along the left breast root seam of the left breast cup, and wherein the inner cradle layer, the outer cradle layer, the right curved sling, an/the outer layer of the right breast cup, a/the middle layer of the right breast cup, and an/the inner layer of the right breast cup are all coupled together along the right breast root seam of the right breast cup.

A4. The garment of any of paragraphs A1-A3.4, wherein the under-bust cradle is configured to provide a stabilizing foundation for the bodice system against the wearer's body.

A5. The garment of any of paragraphs A1-A4, wherein the under-bust cradle is configured to provide structure and stability for the left breast cup and the right breast cup.

A6. The garment of any of paragraphs A1-A5, wherein the under-bust cradle comprises a first superior edge portion that is at least substantially congruent with the left breast root seam, and wherein the under-bust cradle comprises a second superior edge portion that is at least substantially congruent with the right breast root seam.

A7. The garment of any of paragraphs A1-A6, wherein the under-bust cradle is configured to secure a position of each of the left breast cup and the right breast cup with respect to the wearer's breasts when the garment is worn.

A8. The garment of any of paragraphs A1-A7, wherein the under-bust cradle is coupled to the medial piece, the lateral piece, and the superior piece of each of the left breast cup and the right breast cup.

A9. The garment of any of paragraphs A1-A8, wherein the under-bust cradle comprises an/the inner cradle layer and an/the outer cradle layer.

A10. The garment of paragraph A9, wherein the outer cradle layer comprises soft stretch fabric.

A11. The garment of paragraph A9 or A10, wherein the inner cradle layer comprises a non-stretch textile.

A12. The garment of any of paragraphs A9-A11, wherein the outer cradle layer and the inner cradle layer are coupled together along the superior edge of the under-bust cradle.

A13. The garment of any of paragraphs A9-A12, wherein an inferior edge of the inner cradle layer is coupled to the elastic support band.

A14. The garment of any of paragraphs A9-A13, wherein an inferior edge of the outer cradle layer is not coupled to the elastic support band or an/the inferior edge of the inner cradle layer.

A15. The garment of any of paragraphs A1-A14, wherein the under-bust cradle extends across an entire anterior portion of the bodice system.

A16. The garment of any of paragraphs A1-A15, wherein the under-bust cradle comprises a cradle reinforcement tab.

A17. The garment of paragraph A16, wherein the cradle reinforcement tab is sandwiched between an/the inner cradle layer and an/the outer cradle layer.

A18. The garment of paragraph A16 or A17, wherein the cradle reinforcement tab is configured to urge the wearer's breasts laterally away from a centerline of the bodice system.

A19. The garment of any of paragraphs A16-A18, wherein the cradle reinforcement tab comprises a/the non-stretch textile.

A20. The garment of any of paragraphs A16-A19, wherein the cradle reinforcement tab is positioned such that at least a portion of the cradle reinforcement tab is medial to each of the left breast cup and the right breast cup.

A21. The garment of any of paragraphs A16-A20, wherein the cradle reinforcement tab abuts the superior piece and/or the medial piece(s) of each of the left breast cup and the right breast cup.

A22. The garment of any of paragraphs A16-A21, wherein the cradle reinforcement tab extends from a superior tab edge to an inferior tab edge, and wherein the inferior tab edge is spaced apart from and superior to the elastic support band.

A23. The garment of any of paragraphs A16-A22, wherein the cradle reinforcement tab is configured to reinforce the under-bust cradle.

A24. The garment of any of paragraphs A1-A23, wherein each of the left breast cup and the right breast cup comprises:

an obliquely-extending overbust seam extending along an inferior edge of the superior piece, from a lateral edge of the superior piece along an arm hole opening, to a medial edge of the superior piece along the respective left or right breast root seam; and a vertically-extending seam extending between the lateral piece and the medial piece, wherein the vertically-extending seam intersects the obliquely-extending overbust seam and the respective breast root seam.

A24.1. The garment of paragraph A24, wherein the vertically-extending seam intersects the obliquely-extending overbust seam at a respective cup bust point of each of the left breast cup and right breast cup.

A25. The garment of paragraph A24 or A24.1, wherein the obliquely-extending overbust seam and the vertically-extending seam are curved to create contours, thereby being configured to create roundness in and contribute to projection of the wearer's breasts.

A26. The garment of any of paragraphs A1-A25, wherein the left curved sling and the right curved sling comprise a/the non-stretch textile.

A27. The garment of any of paragraphs A1-A26, wherein a first portion of the left curved sling is positioned between a/the first superior piece and a/the third superior piece of the left breast cup, a second portion of the left curved sling is positioned between a/the first lateral piece and a/the third lateral piece of the left breast cup, a third portion of the left curved sling is positioned between a/the first medial piece and a/the third medial piece of the left breast cup, a first portion of the right curved sling is positioned between a/the first superior piece and a/the third superior piece of the right breast cup, a second portion of the right curved sling is positioned between a/the first lateral piece and a/the third lateral piece of the right breast cup, and a third portion of the right curved sling is positioned between a/the first medial piece and a/the third medial piece of the right breast cup.

A28. The garment of any of paragraphs A1-A27, wherein the left curved sling and the right curved sling are positioned relative to the wearer's breasts at least partially via the under-bust cradle and the elastic support band.

A29. The garment of any of paragraphs A1-A28, wherein the left curved sling and the right curved sling are configured to achieve a lifted and rounded breast shape with a balance of fullness from top to bottom of wearer's breasts.

A30. The garment of any of paragraphs A1-A29, wherein the left curved sling and the right curved sling are configured to convey an appearance of full breast volume or breast capacity by lifting the wearer's breasts and/or increasing visible surface area of the wearer's breasts.

A31. The garment of any of paragraphs A1-A30, wherein the left curved sling and the right curved sling are configured to prevent the wearer's breasts from spilling to lateral sides of each of the left breast cup and the right breast cup by lifting the wearer's breasts inwards and away from the wearer's armpits.

A32. The garment of any of paragraphs A1-A31, wherein the left curved sling and the right curved sling intersect a/the cradle reinforcement tab of the under-bust cradle to create a continuous line of hold and support along the left breast root seam and the right breast root seam of the bodice system.

A33. The garment of any of paragraphs A1-A32, wherein the left curved sling and the right curved sling vary in width to deliver continuous lift towards a/the cup bust point of the left breast cup and the right breast cup, respectively.

A34. The garment of any of paragraphs A1-A33, wherein the left curved sling and the right curved sling each comprise a respective region of maximum width, wherein the region of maximum width of the left curved sling is positioned to overlap the lateral piece of the left breast cup adjacent the superior piece of the left breast cup, and wherein the region of maximum width of the right curved sling is positioned to overlap the lateral piece of the right breast cup adjacent the superior piece of the right breast cup.

A35. The garment of any of paragraphs A1-A34, wherein the elastic support band extends around a circumference of the bodice system.

A36. The garment of any of paragraphs A1-A35, wherein the elastic support band is not exposed or visible when the garment is worn.

A37. The garment of any of paragraphs A1-A36, wherein the elastic support band is coupled to an/the inner cradle layer of the under-bust cradle along the anterior portion of the elastic support band, and wherein the elastic support band is coupled to the flexible back aligning member along the entirety of the posterior portion of the elastic support band.

A38. The garment of any of paragraphs A1-A37, wherein the elastic support band comprises plush back elastic configured to provide firm but non-restrictive hold against the wearer's torso.

A39. The garment of any of paragraphs A1-A38, wherein the elastic support band is configured to serve as a basis of support so that the wearer's breasts do not fall below the elastic support band.

A40. The garment of any of paragraphs A1-A39, wherein the elastic support band has an elasticity sufficient to allow for the garment to be donned in a pull-on fashion.

A41. The garment of any of paragraphs A1-A40, wherein the elastic support band is configured to hold the under-bust cradle in place inferior to the wearer's breasts.

A42. The garment of any of paragraphs A1-A41, wherein the elastic support band is configured to provide support and lift, even for larger size breasts.

A43. The garment of any of paragraphs A1-A42, wherein the elastic support band is configured to remain inferior to the wearer's breasts when the garment is worn, wherein the elastic support band is configured to prevent the wearer's breasts from falling below the elastic support band, and wherein the elastic support band is configured to secure the garment in the back so the garment does not ride-up the wearer's back.

A44. The garment of any of paragraphs A1-A43, wherein the flexible back aligning member is integrally formed with the left shoulder strap and the right shoulder strap.

A45. The garment of any of paragraphs A1-A44, wherein the flexible back aligning member comprises an interior layer and an exterior layer, wherein the interior layer is coupled to the elastic support band along the posterior region of the elastic support band, thereby being configured to provide support to the wearer's breasts from a posterior side of the garment.

A46. The garment of paragraph A45, wherein the interior layer comprises a stretch textile.

A47. The garment of paragraph A45 or A46, wherein the exterior layer comprises a/the soft stretch fabric.

A48. The garment of any of paragraphs A1-A47, wherein the flexible back aligning member is supportive and flexible such that the garment is configured to be stretched and pulled onto and thus, over the wearer's breasts, and wherein the bodice system and the garment as a whole are devoid of hardware, such as adjustable clasps and closures.

A49. The garment of any of paragraphs A1-A48, wherein at least a portion of the flexible back aligning member is directly coupled to the elastic support band.

A50. The garment of any of paragraphs A1-A49, wherein the left shoulder strap and the right shoulder strap are non-adjustable in length.

A51. The garment of any of paragraphs A1-A50, wherein the left shoulder strap and the right shoulder strap are devoid of laterally extending seams within a respective superior region of each of the left shoulder strap and the right shoulder strap.

A52. The garment of any of paragraphs A1-A51, wherein the left shoulder strap is coupled to the left breast cup and wherein the right shoulder strap is coupled to the right breast cup, such that the bodice system is configured to provide even lift to the wearer's breasts from the left breast cup and the right breast cup along an anterior side of the garment, through the integrally formed flexible back aligning member.

A53. The garment of any of paragraphs A1-A52, wherein the left shoulder strap is coupled to the left curved sling and wherein the right shoulder strap is coupled to the right curved sling, such that the bodice system is configured to create continuous lift from the under-bust cradle along the left breast root seam and the right breast root seam, through the left breast cup and the right breast cup, and to the wearer's overbust, via the left shoulder strap and the right shoulder strap.

A53.1. The garment of any of paragraphs A1-A53, wherein the left shoulder strap and the right shoulder strap are configured to bridge between and lift from a/the anterior side of the bodice system through a/the posterior side of the bodice system, wherein the left shoulder strap and the right shoulder strap are configured to continue a lifting action over the shoulders, down across the wearer's back, ending where a/the interior layer of the flexible back aligning member meets the elastic support band.

A53.2. The garment of any of paragraphs A1-A53.1, wherein each of the left curved sling and the right curved sling comprises a superior sling edge, wherein the superior sling edge of the left curved sling is coupled to the left shoulder strap, and wherein the superior sling edge of the right curved sling is coupled to the right shoulder strap.

A53.3. The garment of paragraph A53.2, wherein a first sling length of the superior sling edge of the left curved sling is at least substantially equal to a first strap length of the left shoulder strap, where the left shoulder strap is coupled to the left curved sling, and wherein a second sling length of the superior sling edge of the right curved sling is at least substantially equal to a second strap length of the right shoulder strap, where the right shoulder strap is coupled to the right curved sling.

A54. The garment of any of paragraphs A1-A53.3, wherein the bodice system is devoid of clasps, closures, buckles, underwire, or other hardware.

A55. The garment of any of paragraphs A1-A54, wherein the bodice system is configured to provide shaping and roundness to the wearer's breasts.

A56. The garment of any of paragraphs A1-A55, wherein the bodice system is configured to provide lift, shape, and support to the wearer's breasts, including D-cup and larger size breasts.

A57. The garment of any of paragraphs A1-A56, wherein the bodice system is configured to be flexible, comfortable, and avoid digging in or flattening of the wearer's breasts.

A58. The garment of any of paragraphs A1-A57, wherein the bodice system is configured to create breast separation and evenness for the wearer's breasts.

A59. The garment of any of paragraphs A1-A58, wherein the bodice system further comprises a left elastic strip extending along a left armhole and a right elastic strip extending along a right armhole of the garment, wherein the left armhole is partially defined by a lateral edge region of a/the left shoulder strap and a lateral edge region of the left breast cup, and wherein the right armhole is partially defined by a lateral edge region of a/the right shoulder strap and a lateral edge region of the right breast cup.

A60. The garment of paragraph A59, wherein the left elastic strip and the right elastic strip comprise a/the plush back elastic having a modulus of elasticity sufficient to provide optimal grip at a/the armholes of the garment, to support and lift the wearer's breasts, even larger size breasts.

A61. The garment of any of paragraphs A1-A59, wherein the bodice system further comprises a second elastic strip that extends along or within a superior edge region of the flexible back aligning member, along a medial edge region of the left shoulder strap, and along a medial edge region of the right shoulder strap.

A62. The garment of paragraph A61, wherein the second elastic strip is narrower in width and lighter in strength than a/the left elastic strip of a/the left armhole and a/the right elastic strip of a/the right armhole to provide modest and discreet grip and hold against the wearer's body.

A63. The garment of any of paragraphs A1-A62, wherein the left breast root seam and the right breast root seam comprise a binding configured to increase stability and support of the left breast cup and the right breast cup without the use of underwire or hardware.

A64. The garment of any of paragraphs A1-A63, wherein a/the first lateral piece, a/the first medial piece, and a/the first superior piece of each of the left breast cup and the right breast cup comprise a first stretch fabric.

A65. The garment of any of paragraphs A1-A64, wherein a/the second lateral piece and a/the second medial piece of each of the left breast cup and the right breast cup comprise a second stretch fabric.

A66. The garment of paragraphs A64 and A65, wherein the first stretch fabric is the same as the second stretch fabric.

A67. The garment of paragraph A66, wherein the first stretch fabric and the second stretch fabric comprise Modal.

A68. The garment of paragraphs A64 and A65, wherein the first stretch fabric is different from the second stretch fabric in terms of material composition, weight, thickness, insulation, and/or elasticity.

A69. The garment of any of paragraphs A1-A68, wherein a/the third medial piece, a/the third lateral piece, and a/the third superior piece of each of the left breast cup and the right breast cup comprise a first stretch textile.

A70. The garment of paragraph A69, wherein the first stretch textile comprises a four-way stretch mesh textile.

A71. The garment of any of paragraphs A1-A70, wherein a/the second superior piece of each of the left breast cup and the right breast cup comprises a lace fabric.

A72. The garment of any of paragraphs A1-A71, wherein the left curved sling and the right curved sling comprise a/the non-stretch textile.

A73. The garment of any of paragraphs A1-A72, further comprising a/the skirt that extends inferiorly from the under-bust cradle and the flexible back aligning member, and wherein the skirt comprises a/the soft stretch fabric.

A74. The garment of paragraph A73, wherein the skirt extends inferiorly from the under-bust cradle to an inferior skirt edge, wherein the inferior skirt edge is distal to the wearer's navel, distal to the wearer's waist, distal to the wearer's hips, distal to the wearer's buttocks, and/or distal to the wearer's mid-thigh.

A75. The garment of any of paragraphs A1-A74, wherein an anterior side of the bodice system comprises both stretchable and non-stretch materials.

A76. The garment of paragraph A75, wherein a posterior side of the bodice system comprises the stretchable materials.

A77. The garment of any of paragraphs A1-A76, wherein the garment comprises the bodice system integrated into a bra, a bra top, a corset, swimwear, a swim top, a single-piece swim top, a one-piece swimsuit, a top, a crop top, a blouse, a shirt, a camisole, a sports bra, a sports top, an athletic top, or a dress.

B1. A garment having a bodice system configured to provide lift, shape, and support to a wearer's breasts, the bodice system comprising:

a left breast cup and a right breast cup, each of the left and right breast cups comprising:

an inner layer formed of three pieces comprising a first lateral piece, a first medial piece, and a first superior piece, wherein the first lateral piece is coupled to the first medial piece such that the first medial piece is positioned medially to the first lateral piece when the garment is worn, wherein the first superior piece is coupled to the first lateral piece and the first medial piece such that the first superior piece is positioned superiorly to the first lateral piece and the first medial piece when the garment is worn, and wherein the inner layer is configured to be positioned nearest the wearer's skin when the garment is worn;

an outer layer formed of three pieces comprising a second lateral piece, a second medial piece, and a second superior piece, wherein the second lateral piece is coupled to the second medial piece such that the second medial piece is positioned medially to the second lateral piece when the garment is worn, wherein the second superior piece is coupled to the second lateral piece and the second medial piece such that the second superior piece is positioned superiorly to the second lateral piece and the second medial piece when the garment is worn, and wherein the outer layer is configured to be positioned facing outwardly from the wearer when the garment is worn; and a middle layer formed of three pieces comprising a third lateral piece, a third medial piece, and a third superior piece, wherein the third lateral piece is coupled to the third medial piece such that the third medial piece is positioned medially to the third lateral piece when the garment is worn, wherein the third superior piece is coupled to the third lateral piece and the third medial piece such that the third superior piece is positioned superiorly to the third lateral piece and the third medial piece when the garment is worn, and wherein the middle layer is sandwiched between the outer layer and the inner layer;

a left curved sling and a right curved sling, wherein each of the left curved sling and the right curved sling is configured to support the wearer's breasts by urging the wearer's breasts in medial and superior directions, wherein the left curved sling is positioned between the inner layer and the middle layer of the left breast cup, and wherein the right curved sling is positioned between the inner layer and the middle layer of the right breast cup;

an under-bust cradle configured to be positioned inferior to the wearer's breasts when the garment is worn, wherein the under-bust cradle comprises:

an inner cradle layer, wherein the inner cradle layer is coupled to the first medial piece, the first lateral piece, and the first superior piece of each of the left breast cup and the right breast cup; and an outer cradle layer, wherein the outer cradle layer is coupled to the second medial piece, the second lateral piece, and the second superior piece of each of the left breast cup and the right breast cup;

an elastic support band extending circumferentially around the wearer's torso when the garment is worn, wherein the elastic support band is positioned inferior to the under-bust cradle, wherein the elastic support band is coupled to the inner cradle layer, and wherein the elastic support band and the under-bust cradle together are configured to support the wearer's breasts; and a skirt extending inferiorly from the under-bust cradle.

B2. The garment of paragraph B1, further comprising any of the features recited in any of paragraphs A1-A77.

B3. The garment of paragraph B1 or B2, wherein the inner cradle layer, the outer cradle layer, the left curved sling, the outer layer of the left breast cup, the middle layer of the left breast cup, and the inner layer of the left breast cup are all coupled together along a left breast root seam of the left breast cup, and wherein the inner cradle layer, the outer cradle layer, the right curved sling, the outer layer of the right breast cup, the middle layer of the right breast cup, and the inner layer of the right breast cup are all coupled together along a right breast root seam of the right breast cup.

C1. A method of sizing the garment of any of paragraphs A1-A77 or B1-B3, the method comprising:

providing a plurality of the garments in different size combinations that pair a band size of the elastic support band with a breast cup size of the left breast cup and the right breast cup; and measuring a torso circumference and a cup size of the wearer to select a garment size from among the plurality of the garments, wherein the respective breast cup sizes of the plurality of the garments are configured to allow wearers to select between tighter and looser fits with respect to the measured cup size of the wearer.

C2. The method of paragraph C1, wherein the band sizes range from 30-40 inches.

C3. The method of paragraph C1 or C2, wherein the breast cup sizes range from C-H.

C4. The method of any of paragraphs C1-C3, wherein the breast cup sizes comprise hybrid sizes including C/D, D/DD, DD/DDD, DDD/E, E/F, F/G, and/or G/H.

D1. The use of the garment of any of paragraphs A1-A77 or B1-B3 to provide breast lift, shape, support, and comfort.

As used herein, the terms "selective" and "selectively," when modifying an action, movement, configuration, or other activity of one or more components or characteristics of an apparatus, mean that the specific action, movement, configuration, or other activity is a direct or indirect result of dynamic processes and/or user manipulation of an aspect of, or one or more components of, the apparatus. The terms "selective" and "selectively" thus may characterize an activity that is a direct or indirect result of user manipulation of an aspect of, or one or more components of, the apparatus, or may characterize a process that occurs automatically, such as via the mechanisms disclosed herein.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one example, to at least one, optionally including more than one, A, with no B present (and optionally including entities other than B); in another example, to at least one, optionally including more than one, B, with no A present (and optionally including entities other than A); in yet another example, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, or A, B, and C together, and optionally any of the above in combination with at least one other entity.

As used herein, the phrase "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, a first direction that is at least substantially parallel to a second direction includes a first direction that is within an angular deviation of 22.5° relative to the second direction and also includes a first direction that is identical to the second direction. As another example, "substantially vertical" includes not only lines within 22.5 degrees of vertical, but also curves and contours that extend in an overall vertical direction, even if those curves and contours are not straight lines. As used herein, the term "substantially," when modifying a shape, position, function, or feature (e.g., "substantially collinear" or "substantially congruent"), includes not only the recited "substantial" shape, position, function, or feature, but also the full extent of the recited shape, position, function, or feature. A substantial shape, position, function, or feature means that the relevant component of the bodice system or garment is sufficiently close to having the as-described shape, position, function, or feature such that performance of the component, from the perspective of one with ordinary skill in the art, is the same as though the component is precisely meeting the recited shape, position, function, or feature.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

As used herein, the phrase, "for example," the phrase, "as an example," and/or simply the term "example," when used with reference to one or more components, features, details, structures, examples, and/or methods according to the present disclosure, are intended to convey that the described component, feature, detail, structure, example, and/or method is an illustrative, non-exclusive example of components, features, details, structures, examples, and/or methods according to the present disclosure. Thus, the described component, feature, detail, structure, example, and/or method is not intended to be limiting, required, or exclusive/exhaustive; and other components, features, details, structures, examples, and/or methods, including structurally and/or functionally similar and/or equivalent components, features, details, structures, examples, and/or methods, are also within the scope of the present disclosure.

The invention claimed is:

1. A garment having a bodice system configured to provide lift, shape, and support to a wearer's breasts, the bodice system comprising:

a left breast cup and a right breast cup, wherein each of the left and right breast cups comprises a lateral piece, a medial piece, and a superior piece, wherein the lateral piece is coupled to the medial piece such that the medial piece is positioned medially to the lateral piece when the garment is worn, wherein the superior piece is coupled to the lateral piece and the medial piece such that the superior piece is positioned superiorly to the lateral piece and the medial piece when the garment is worn;

an under-bust cradle, wherein at least a portion of the under-bust cradle is configured to be positioned inferior to the wearer's breasts when the garment is worn, wherein a superior edge of the under-bust cradle extends along a left breast root seam of the left breast cup and along a right breast root seam of the right breast cup of the bodice system, wherein the left breast root seam and the right breast root seam are configured to be positioned along respective left and right breast roots root of the wearer when the garment is worn; wherein the under-bust cradle extends continuously across an anterior side of the garment below the left breast cup and the right breast cup;

an elastic support band configured to extend circumferentially around the wearer's torso when the garment is worn, wherein an anterior portion of the elastic support band is coupled to and positioned inferior to the under-bust cradle, and wherein the elastic support band and the under-bust cradle together are configured to support the wearer's breasts;

a left curved sling and a right curved sling, wherein each of the left curved sling and the right curved sling is configured to work with the left breast cup and the right breast cup, respectively, to lift, shape, and support the wearer's breasts by urging the wearer's breasts in medial and superior directions, wherein the left curved sling is sized and positioned to overlap with at least a portion of the lateral piece, the medial piece, and the superior piece of the left breast cup, and wherein the right curved sling is sized and positioned to overlap with at least a portion of the lateral piece, the medial piece, and the superior piece of the right breast cup;

a left shoulder strap coupled to the left breast cup and a right shoulder strap coupled to the right breast cup; and a flexible back aligning member extending inferiorly from the left shoulder strap and the right shoulder strap, wherein at least a portion of the flexible back aligning member is coupled to the elastic support band along a posterior portion of the elastic support band, wherein the flexible back aligning member is configured to be positioned against the wearer's back when the garment is worn;

wherein each of the left breast cup and the right breast cup comprises an inner layer and an outer layer, wherein the inner layer comprises a stretch fabric, and wherein the outer layer comprises a stretch fabric; wherein the left curved sling is positioned between the inner layer and the outer layer of the left breast cup, and wherein the right curved s ling is positioned between the inner layer and the outer layer of the right breast cup.

2. The garment according to claim 1, wherein the left curved sling and the right curved sling comprise a non-stretch mesh, wherein an inner cradle layer of the under-bust cradle comprises a non-stretch mesh, and wherein an interior layer of the flexible back aligning member comprises a stretch mesh.

3. The garment according to claim 1, wherein the under-bust cradle is coupled to the medial piece, the lateral piece, and the superior piece of each of the left breast cup and the right breast cup, wherein the under-bust cradle comprises an inner cradle layer and an outer cradle layer, and wherein the under-bust cradle comprises a non-stretch mesh.

4. The garment according to claim 3, wherein an inferior edge of the inner cradle layer is coupled to the elastic support band along the anterior portion of the elastic support band, wherein an inferior edge of the outer cradle layer is not directly coupled to the elastic support band or the inferior edge of the inner cradle layer, and wherein the elastic support band is coupled to the flexible back aligning member along the entirety of the posterior portion of the elastic support band.

5. The garment according to claim 3, wherein the outer cradle layer comprises soft stretch fabric, wherein the inner cradle layer comprises a non-stretch textile, and wherein the outer cradle layer and the inner cradle layer are coupled together along the superior edge of the under-bust cradle.

6. The garment according to claim 5, wherein the under-bust cradle comprises a cradle reinforcement tab configured to reinforce the under-bust cradle, wherein the cradle reinforcement tab is sandwiched between the inner cradle layer and the outer cradle layer, wherein the cradle reinforcement tab comprises a non-stretch textile, and wherein the cradle reinforcement tab is positioned such that at least a portion of the cradle reinforcement tab is medial to each of the left breast cup and the right breast cup.

7. The garment according to claim 6, wherein the cradle reinforcement tab extends from a superior tab edge to an inferior tab edge, wherein the inferior tab edge is spaced apart from and superior to the elastic support band, wherein the cradle, and wherein the cradle reinforcement tab is configured to urge the wearer's breasts laterally away from a centerline of the bodice system.

8. The garment according to claim 6, wherein the left curved sling and the right curved sling intersect the cradle reinforcement tab of the under-bust cradle to create a continuous line of hold and support along the left breast root seam and the right breast root seam of the bodice system.

9. The garment according to claim 1, wherein the left curved sling and the right curved sling each comprise a respective region of maximum width, wherein the region of maximum width of the left curved sling is positioned to overlap the lateral piece of the left breast cup adjacent the superior piece of the left breast cup, and wherein the region of maximum width of the right curved sling is positioned to overlap the lateral piece of the right breast cup adjacent the superior piece of the right breast cup, and wherein the left curved sling and the right curved sling vary in width to deliver continuous lift towards a cup bust point of the left breast cup and the right breast cup, respectively.

10. The garment according to claim 1, wherein the left curved sling and the right curved sling comprise a non-stretch textile, wherein the left curved sling extends inferiorly from the left shoulder strap and curves medially towards the medial piece of the left breast cup, wherein the left curved sling tapers to get thinner as it curves medially, wherein the right curved sling extends inferiorly from the right shoulder strap and curves medially towards the medial piece of the right breast cup, and wherein the right curved sling tapers to get thinner as it curves medially.

11. The garment according to claim 1, wherein each of the left breast cup and the right breast cup comprises:

an obliquely-extending overbust seam extending along an inferior edge of the superior piece, from a lateral edge of the superior piece along an arm hole opening, to a medial edge of the superior piece along the respective left or right breast root seam; and a vertically-extending seam extending between the lateral piece and the medial piece, wherein the vertically-extending seam intersects the obliquely-extending overbust seam and the respective left or right breast root seam at a respective cup bust point of each of the left breast cup and right breast cup.

12. The garment according to claim 1, wherein each of the left breast cup and the right breast cup further comprises a middle layer sandwiched between the outer layer and the inner layer, wherein the lateral piece of each of the left breast cup and the right breast cup comprises a first lateral piece of the inner layer, a second lateral piece of the outer layer, and a third lateral piece of the middle layer, wherein the medial piece of each of the left breast cup and the right breast cup comprises a first medial piece of the inner layer, a second medial piece of the outer layer, and a third medial piece of the middle layer, and wherein the superior piece of each of the left breast cup and the right breast cup comprises a first superior piece of the inner layer, a second superior piece of the outer layer, and a third superior piece of the middle layer.

13. The garment according to claim 12, wherein a first portion of the left curved sling is positioned between the first superior piece and the third superior piece of the left breast cup, a second portion of the left curved sling is positioned between the first lateral piece and the third lateral piece of the left breast cup, a third portion of the left curved sling is positioned between the first medial piece and the third medial piece of the left breast cup, a first portion of the right curved sling is positioned between the first superior piece and the third superior piece of the right breast cup, a second portion of the right curved sling is positioned between the first lateral piece and the third lateral piece of the right breast cup, and a third portion of the right curved sling is positioned between the first medial piece and the third medial piece of the right breast cup.

14. The garment according to claim 1, wherein the elastic support band extends around a circumference of the bodice system, and wherein the elastic support band is not exposed or visible when the garment is worn.

15. The garment according to claim 1, wherein the flexible back aligning member is integrally formed with the left shoulder strap and the right shoulder strap.

16. The garment according to claim 1, wherein the flexible back aligning member is supportive and flexible such that the garment is configured to be stretched and pulled onto and thus, over the wearer's breasts, and wherein the bodice system and the garment as a whole are devoid of hardware, clasps, and closures.

17. The garment according to claim 1, wherein the left shoulder strap is coupled to the left curved sling and wherein the right shoulder strap is coupled to the right curved sling, such that the bodice system is configured to create continuous lift from the under-bust cradle along the left breast root seam and the right breast root seam, through the left breast cup and the right breast cup, and to the wearer's overbust, via the left shoulder strap and the right shoulder strap.

18. The garment according to claim 1, wherein the bodice system further comprises a skirt extending inferiorly from the under-bust cradle.

19. The garment according to claim 1, wherein the garment comprises the bodice system integrated into a bra, a bra top, a corset, swimwear, a swim top, a single-piece swim top, a one-piece swimsuit, a top, a crop top, a blouse, a shirt, a camisole, a sports bra, a sports top, an athletic top, intimate apparel, nightgowns, nightwear, sleepwear, pajamas, lingerie, night shirts, negligees, teddies, chemises, camisoles, loungewear, or a dress.

20. The garment according to claim 1, wherein the under-bust cradle comprises a textile with little-to-no elasticity.

21. The garment according to claim 1, wherein the under-bust cradle comprises a heavier weight material than a material used to form the left breast cup and the right breast cup.

22. A garment having a bodice system configured to provide lift, shape, and support to a wearer's breasts, the bodice system comprising:

a left breast cup and a right breast cup, each of the left and right breast cups comprising:

an inner layer formed of three pieces comprising a first lateral piece, a first medial piece, and a first superior piece, wherein the first lateral piece is coupled to the first medial piece such that the first medial piece is positioned medially to the first lateral piece when the garment is worn, wherein the first superior piece is coupled to the first lateral piece and the first medial piece such that the first superior piece is positioned superiorly to the first lateral piece and the first medial piece when the garment is worn, and wherein the inner layer is configured to be positioned nearest the wearer's skin when the garment is worn;

an outer layer formed of three pieces comprising a second lateral piece, a second medial piece, and a second superior piece, wherein the second lateral piece is coupled to the second medial piece such that the second medial piece is positioned medially to the second lateral piece when the garment is worn, wherein the second superior piece is coupled to the second lateral piece and the second medial piece such that the second superior piece is positioned superiorly to the second lateral piece and the second medial piece when the garment is worn, and wherein the outer layer is configured to be positioned facing outwardly from the wearer when the garment is worn; and a middle layer formed of three pieces comprising a third lateral piece, a third medial piece, and a third superior piece, wherein the third lateral piece is coupled to the third medial piece such that the third medial piece is positioned medially to the third lateral piece when the garment is worn, wherein the third superior piece is coupled to the third lateral piece and the third medial piece such that the third superior piece is positioned superiorly to the third lateral piece and the third medial piece when the garment is worn, and wherein the middle layer is sandwiched between the outer layer and the inner layer;

a left curved sling and a right curved sling, wherein each of the left curved sling and the right curved sling is configured to support the wearer's breasts by urging the wearer's breasts in medial and superior directions, wherein the left curved sling is positioned between the inner layer and the middle layer of the left breast cup, and wherein the right curved sling is positioned between the inner layer and the middle layer of the right breast cup;

an under-bust cradle configured to be positioned inferior to the wearer's breasts when the garment is worn, wherein the under-bust cradle comprises:

an inner cradle layer, wherein the inner cradle layer is coupled to the first medial piece, the first lateral piece, and the first superior piece of each of the left breast cup and the right breast cup; and an outer cradle layer, wherein the outer cradle layer is coupled to the second medial piece, the second lateral piece, and the second superior piece of each of the left breast cup and the right breast cup, wherein the inner cradle layer, the outer cradle layer, the left curved sling, the outer layer of the left breast cup, the middle layer of the left breast cup, and the inner layer of the left breast cup are all coupled together along a left breast root seam of the left breast cup, and wherein the inner cradle layer, the outer cradle layer, the right curved sling, the outer layer of the right breast cup, the middle layer of the right breast cup, and the inner layer of the right breast cup are all coupled together along a right breast root seam of the right breast cup;

an elastic support band extending circumferentially around the wearer's torso when the garment is worn, wherein the elastic support band is positioned inferior to the under-bust cradle, wherein the elastic support band is coupled to the inner cradle layer, and wherein the elastic support band and the under-bust cradle together are configured to support the wearer's breasts; and a skirt extending inferiorly from the under-bust cradle.

* * * * *